US008106897B2

(12) United States Patent
Uchida et al.

(10) Patent No.: US 8,106,897 B2
(45) Date of Patent: Jan. 31, 2012

(54) DISPLAY DRIVE CONTROL DEVICE AND ELECTRIC DEVICE INCLUDING DISPLAY DEVICE

(75) Inventors: Takatoshi Uchida, Kodaira (JP); Goro Sakamaki, Fuchu (JP); Kei Tanabe, Koganei (JP); Yasuhito Kurokawa, Kodaira (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 1105 days.

(21) Appl. No.: 11/944,273

(22) Filed: Nov. 21, 2007

(65) Prior Publication Data

US 2008/0088259 A1 Apr. 17, 2008

Related U.S. Application Data

(63) Continuation of application No. 10/752,570, filed on Jan. 8, 2004, now Pat. No. 7,317,461.

(30) Foreign Application Priority Data

Jan. 31, 2003 (JP) ..... 2003-023424

(51) Int. Cl.
*G09G 5/00* (2006.01)

(52) U.S. Cl. ..... 345/204; 345/87

(58) Field of Classification Search ..... 345/87–102, 345/204

See application file for complete search history.

(56) References Cited

U.S. PATENT DOCUMENTS 6,518,946 B2 2/2003 Ode et al.
7,034,868 B2 * 4/2006 Sasaki ..... 348/222.1
7,126,618 B2 * 10/2006 Hirumi et al. ..... 347/171
7,176,947 B2 * 2/2007 Kudo et al. ..... 345/690
7,289,084 B2 * 10/2007 Lesniak ..... 345/1.1
7,317,461 B2 * 1/2008 Uchida et al. ..... 345/690
7,330,163 B2 * 2/2008 Nakai et al. ..... 345/1.1
2001/0024183 A1 9/2001 Ode et al.
2002/0011998 A1 * 1/2002 Tamura ..... 345/204
2002/0054229 A1 5/2002 Sasaki
2002/0075272 A1 6/2002 Tani et al.
2002/0175887 A1 * 11/2002 Yamazaki ..... 345/87
2003/0058229 A1 3/2003 Kawabe et al.
2004/0155848 A1 * 8/2004 Kudo et al. ..... 345/89

OTHER PUBLICATIONS

Office Action dated Jun. 10, 2011, from Taiwanese Patent Application No. 095146122.

* cited by examiner

*Primary Examiner* — Nitin Patel
(74) *Attorney, Agent, or Firm* — Miles & Stockbridge P.C.

(57) ABSTRACT

In a system including a color liquid crystal panel, a liquid crystal display drive control device for driving the panel, and a microprocessor, the display drive control device of the invention lightens the burden imposed on a microprocessor as well as reduces the power consumption of the system. In the liquid crystal display drive control device that incorporates a memory for storing image data displayed on a color liquid crystal panel, reads out the image data sequentially from the memory, generates image signals of the three primary colors for each pixels of the color liquid crystal panel, and outputs the image signals from external output terminals, the display drive control device includes a transparency arithmetic circuit that applies a calculation processing to two image data read out from the built-in memory and generates data for a transparent display, supplies display data generated by the transparency arithmetic circuit to a driver, and makes the driver generate and output drive signals to the liquid crystal panel.

14 Claims, 18 Drawing Sheets

FIG. 7(A)

BASIC IMAGE

| | | | | | | | | | | | |
|---|---|---|---|---|---|---|---|---|---|---|---|
| R5 | R4 | R3 | R2 | R1 | R0 | G5 | G4 | G3 | G2 | G1 | G0 |
| B5 | B4 | B3 | B2 | B1 | B0 | | | | | | |

FIG. 7(B)

OSD IMAGE FORMAT 1

| | | | | | | | | | | | |
|---|---|---|---|---|---|---|---|---|---|---|---|
| α2 | α1 | α0 | R4 | R3 | R2 | R1 | R0 | G4 | G3 | G2 | G1 |
| G0 | B4 | B3 | B2 | B1 | B0 | | | | | | |

TRANSPARENCY SETTING BIT (α BIT)

FIG. 7(C)

OSD IMAGE FORMAT 2

| | | | | | | | | | | | |
|---|---|---|---|---|---|---|---|---|---|---|---|
| R4 | R3 | R2 | R1 | R0 | α2 | G4 | G3 | G2 | G1 | G0 | α1 |
| B4 | B3 | B2 | B1 | B0 | α0 | | | | | | |

DISPLAY DRIVE CONTROL DEVICE AND ELECTRIC DEVICE INCLUDING DISPLAY DEVICE

CROSS-REFERENCE TO RELATED APPLICATION

This application is a continuation of application Ser. No. 10/752,570 filed Jan. 8, 2004 now U.S. Pat. No. 7,317,461.

BACKGROUND OF THE INVENTION

The present invention relates to a technique effective in application to a display drive control device to drive a display device as well as a display drive control device incorporated into a semiconductor integrated circuit, specifically to a technique effective in use for a liquid crystal display drive control device to drive a collar liquid crystal panel used in a portable electronic device such as a mobile telephone, and an electronic device such as a mobile telephone using the same.

There has been developing a trend of using a dot-matrix liquid crystal panel having multiple pixels arrayed in matrix two-dimensionally in the display of a portable electronic device such as a mobile telephone or a PDA (Personal Digital Assistant), and in the electronic device is loaded with a liquid crystal display control device (liquid crystal controller) incorporated into a semiconductor integrated circuit that controls the display of the liquid crystal panel, a liquid crystal driver that drives the liquid crystal panel under the control of the control device, or a liquid crystal display drive control device (liquid crystal controller driver) containing the liquid crystal controller and the liquid crystal driver.

Most of the conventional liquid crystal panels used in the portable electronic devices display black-and-white still-picture images. However, the contents displayed on the still-picture images. However, the contents displayed on the panels are increasingly diversified accompanied with the recent trend for higher functionality in the portable electronic devices, and colored or animated displays have become a main current.

In this trend, some electronic devices having color liquid crystal panels display images of information of characters and symbols on parts of background images in a transparent state, utilizing the advantage of the color display, or generate reduced image data on the basis of the image data stored in the memories by means of the resizing function, thus displaying multifarious images through processing of the original image data. Conventionally, it has been a general exercise to carry out these processing through the software of a microprocessor mounted on an electronic device.

The trend for color display or large display in the liquid crystal panel accompanies increase of image data, and the introduction of animated displays involves increase of the contents of processing that a microprocessor is demanded to carry out. Accordingly, when the data processing for a transparent display is carried out through the software of a microprocessor, the microprocessor is required to have high functionality and high-speed processing capability, which invites increase of the system cost as well as prolongs the time from starting the processing till actually presenting the transparent display.

Besides, when the data processing for a transparent display is carried out through the software of a microprocessor, provided that the transparency of first image data is given by $\alpha$, it is necessary to carry out the processing that multiplies $\alpha$ to the first image data, multiplies $(1-\alpha)$ to the second image data, and further adds these results (hereunder, called $\alpha$ blending); thus the contents of processing cannot be relieved of complexity.

The processing for a transparent display by the software will inevitably involve reading out the original image data stored in an external memory, processing the data, and sending the data to a liquid crystal controller driver LSI; accordingly, a repeated execution of a transparent display and a non-transparent display will require the microprocessor to read out the image data from the external memory and send the display data to the liquid crystal controller driver LSI, each time the display is switched, which will unavoidably increase the power consumption and processing time.

A liquid crystal controller driver LSI mounted on a portable electronic device incorporates a memory for storing image data displayed on a liquid crystal panel in many cases, and the trend for color display or large display in the liquid crystal panel will require enlarging the capacity of the built-in memory. However, to enlarge the capacity of the built-in memory will lead to not only increasing the chip size, but also raising the chip cost, which requires an efficient memory management technique for realizing a desired display with a comparably less memory capacity.

Further, there has recently appeared a mobile telephone having liquid crystal panels on both the inside and outside of the body thereof. In such an electronic device as having two liquid crystal panels, to provide a liquid crystal controller driver LSI corresponding to each of the liquid crystal panels will extremely raise the cost. Accordingly, there arises a demand for a technique capable of driving the two liquid crystal panels with one liquid crystal controller driver LSI. However, efforts to realize the liquid crystal controller driver LSI capable of driving the two liquid crystal panels will invite many problems to be solved, for example, increase of the storage capacity that the memory requires, suppression of the power consumption in case of the display of either panel being unnecessary, and so forth.

SUMMARY OF THE INVENTION

The present invention has been made in view of the above problems, and an object of the invention is to provide a display drive control device capable of lightening the burden on a microprocessor, in a system including a color liquid crystal panel, a liquid crystal display drive control device to drive and control the liquid crystal panel, and a microprocessor.

Another object of the invention is to provide a display drive control device capable of reducing the power consumption, in a system including a color liquid crystal panel, a liquid crystal display drive control device to drive and control the liquid crystal panel, and a microprocessor.

Another object of the invention is to provide a display drive control device capable of efficiently managing the built-in memory to reduce not only the chip size but also the chip cost, in a system including a color liquid crystal panel and a liquid crystal display drive control device to drive and control the liquid crystal panel.

Another object of the invention is to provide, in a system including more than two liquid crystal panels, a display drive control device capable of controlling more than two liquid crystal panels by one display drive control device as well as implementing an optimum drive according to each of the panels.

The aforementioned and other objects and novel features of the invention will become apparent from the descriptions and appended drawings of this specification.

According to one aspect of the invention, in the liquid crystal display drive control device that incorporates a memory for storing image data displayed on a color liquid crystal panel, reads out the image data sequentially from the memory, generates image signals of the three primary colors for each pixels of the color liquid crystal panel, and outputs the image signals from external output terminals, the display drive control device includes an image data processor capable of processing two image data read out from the built-in memory and generating data for a transparent display, supplies display data generated by the image data processor to a driver, and makes the driver generate and output drive signals to the liquid crystal panel.

According to the aforementioned means, a transparent display is implemented, even if a microprocessor does not execute processing with software. Since the built-in memory is followed by the image data processor capable of generating data for the transparent display, when a user desires to repeatedly present the transparent display and non-transparent display, the microprocessor does not need to send the display data to the liquid crystal controller driver LSI, each time the display is switched, which makes it possible to reduce the power consumption as the whole system.

The image data processor preferably includes a set of bit shifters that bit-shift the image data, and an adder that adds the first image data and the second image data each bit-shifted by the bit shifters. According to the above means, a comparably simple circuit as the bit shifters is able to attain such image data as the transparency 50%, 25%, 12.5%, . . . required for a transparent display. Since the image data processor can be configured with the bit shifters and the adder to save a complicated arithmetic circuit, the display drive control device, while avoiding the cost increase and lightening the burden on a microprocessor, realizes a transparent display.

The built-in memory is preferably configured to possess a larger storage capacity than the quantity of image data for one screen of the liquid crystal panel; and in a residual area of the built-in memory storing the image data for one screen, other image data to be overlapped with the image data for one screen is stored. Thereby, it is possible to make the built-in memory having a comparably small capacity hold the image data necessary for a transparent display.

Further, in the liquid crystal display drive control device to generate and output drive signals to more than two liquid crystal panels, the display drive control device controls to drive one liquid crystal panel to display and the other panels not to display, sets the storage capacity of a built-in memory to a size in which the sizes of the image data corresponding to each panels are totalized, and makes the built-in memory store the other image data to be overlapped for a transparent display in the storage area corresponding to the non-display panels. Thereby, it is possible to make the built-in memory of a comparably small storage capacity hold the image data for the transparent display.

Further, the display drive control device includes a resizing function that processes image data supplied from the outside to generate data of an image in which the original image is reduced, and makes a residual area of the built-in memory that stores the image data for one screen or a storage area corresponding to any of non-display panels store the image data generated by the resizing function. Thereby, it is possible to make the built-in memory of a comparably small storage capacity hold the image data necessary for displaying other images in reduction on the display screen or on a part of the background image (window area). The display drive control device preferably includes a register capable of designating to make the resizing function active or inactive. Thereby, the display drive control device will attain a liquid crystal display drive control device applicable to both of the system having the resizing function and the system not having the resizing function on the side of a microprocessor.

BRIEF DESCRIPTION OF THE DRAWINGS

FIGS. 7(A) to 7(C) are explanatory charts illustrating the data format of image data for one pixel, handled by the liquid crystal controller driver of the first embodiment;

DETAILED DESCRIPTION OF THE PREFERRED EMBODIMENTS

The preferred embodiments of the invention will be described with reference to the accompanying drawings.

Figure 1:
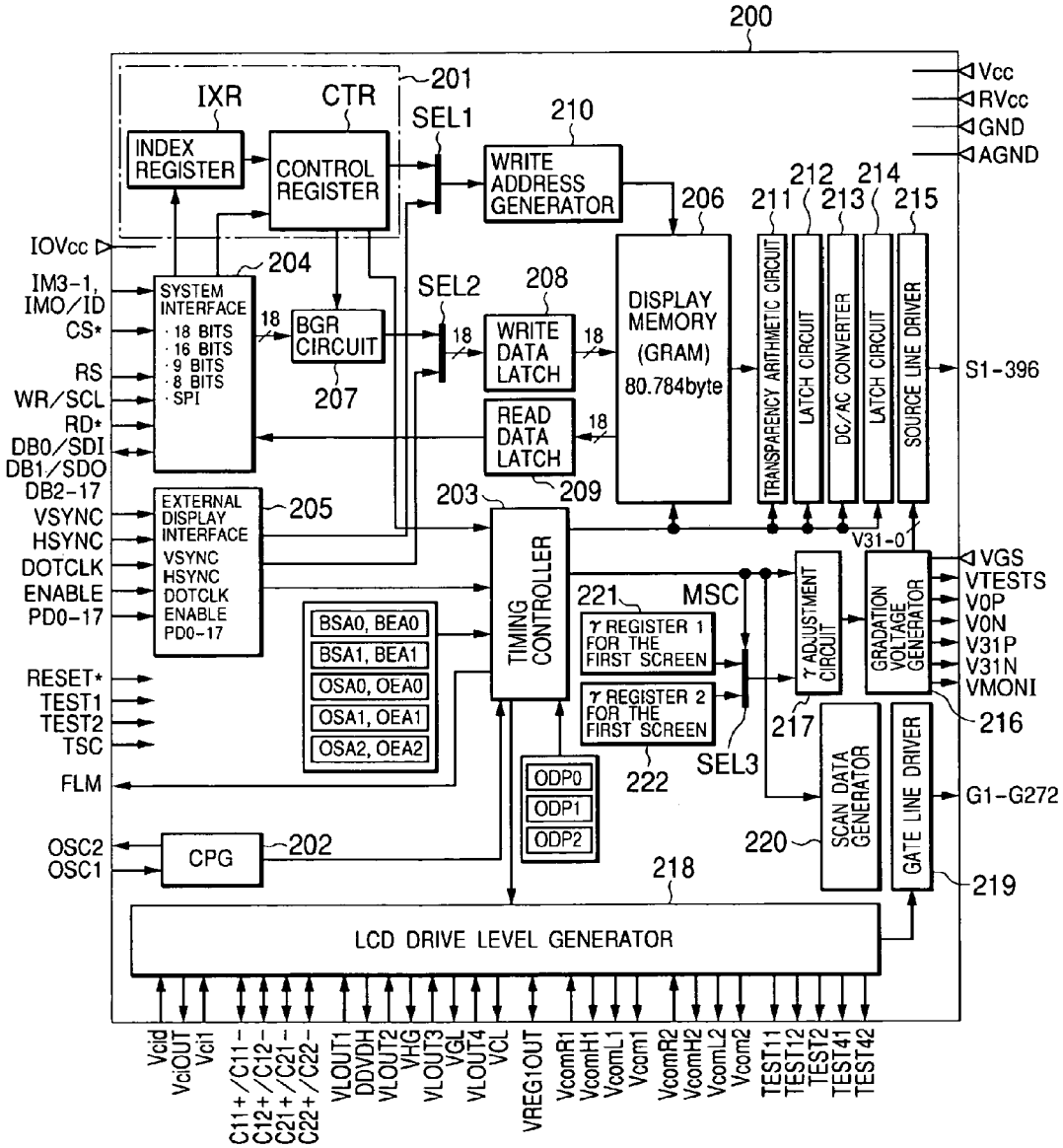
FIG. 1 is a block diagram illustrating the first embodiment of a liquid crystal controller driver to which a display drive control device of the invention is applied.

FIG. 1 illustrates a circuit configuration of a liquid crystal display drive control device (liquid crystal controller driver) relating to the first embodiment of the invention. The liquid crystal controller driver of this embodiment is formed on one semiconductor chip in a semiconductor integrated circuit, which is not restricted to this.

The liquid crystal controller driver 200 of this embodiment includes a control unit 201 that controls the whole inside of the chip on the basis of the commands from an external microprocessor or a microcomputer or the like, a pulse generator 202 that generates a reference clock pulse to the inside of the chip on the basis of an external oscillation signal or an oscillation signal from an oscillator connected to an external terminal, a timing controller 203 that generates timing signals to supply operational timings to various circuits inside the chip on the basis of this clock pulse, a system interface 204 that transmits and receives data such as instructions and still-picture data, etc., to and from the microcomputer or the like through a system bus not illustrated, and an external display interface 205 that receives animation data from an application processor and the like, and horizontal and vertical synchronization signals HSYNC, VSYNC through a display data bus not illustrated. The animation data from the application processor are supplied to be synchronous with a dot clock signal DOTCLK.

The liquid crystal controller driver 200 of this embodiment further includes a display memory 206 composed of a volatile memory capable of read/write, such as an SRAM (Static Random Access Memory) that stores display data according to the bit map system, a bit converter 207 that executes a bit processing such as a bit rearrangement of write data from the microcomputer, a write data latch 208 that holds to fetch image data converted by the bit converter 207, or image data inputted through the external display interface 205, a read data latch 209 that holds image data read from the display memory 206, a write address generator 210 composed of an address counter that generates write addresses to the display memory 206, etc., a transparency arithmetic circuit 211 that executes an arithmetic operation for a transparent display on the basis of image data read from the display memory 206 for the display on the liquid crystal panel, and a latch circuit 212 that holds to fetch display data outputted from the transparency arithmetic circuit 211. The transparency arithmetic circuit 211 is also able to pass the display data as it is, without a transparency arithmetic operation.

Although it is not especially restricted, the timing controller 203 in this embodiment contains a counter that generates read addresses for reading image data from the display memory 206. The display memory 206 possesses a memory array including plural memory cells, an address decoder that decodes addresses supplied from the write address generator 210 and the timing controller 203, and generates signals for selecting word lines and bit lines inside the memory array, and a sense amplifier that amplifies signals read out from the memory cells, or applies a predetermined voltage to the bit lines inside the memory array according to the write data.

Figure 17:
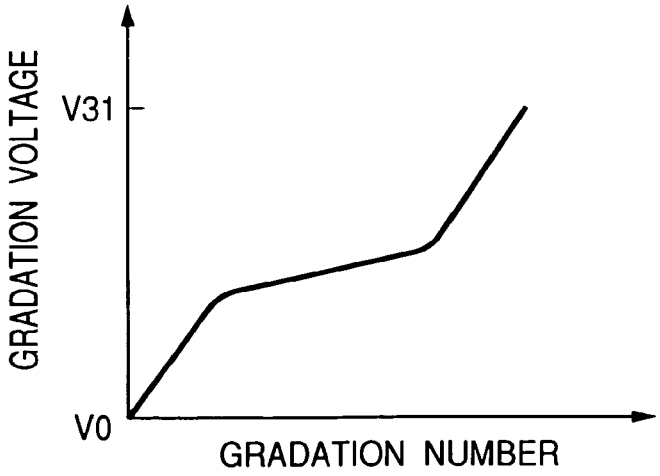
FIG. 17 is a chart illustrating the gradation voltage for correcting the γ characteristic of the liquid crystal panel.

The liquid crystal controller driver 200 of this embodiment further includes a dc/ac converter 213 that converts display data latched by the latch circuit 212 into data for ac drive to prevent degradation of the liquid crystal, a latch circuit 214 that holds data converted by the converter 213, a liquid crystal drive level generator 215 that generates voltages of plural levels required for driving the liquid crystal panel, a gradation voltage generator 216 that generates gradation voltages for generating waveform signals suitable for color display and gradation display on the basis of the voltages generated by the liquid crystal drive level generator 215, a γ adjustment circuit 217 that sets a gradation voltage for correcting the γ characteristic of the liquid crystal panel, which has the characteristic as shown in FIG. 17, a source line driver 215 that selects voltages according to the display data latched by the latch circuit 214 among the gradation voltages supplied from the gradation voltage generator 216, and outputs voltages (source line drive signals) S1 to S396 to be applied to the source lines as the signal lines of the liquid crystal panel, a gate line driver 219 that outputs voltages (gate line drive signals) G1 to G272 to be applied to the gate lines (also called common lines) as the selection lines of the liquid crystal panel, a scan data generator 220 composed of shift registers and so forth, which generate scan data for driving the gate lines of the liquid crystal panel sequentially one by one to the selection level.

Here in FIG. 1, SEL1, SEL2, and SEL3 denote data selectors, which are controlled individually by switching signals outputted from the timing controller 203, and selectively pass either of plural input signals.

The control unit 201 includes a control register CTR that controls the whole operational state of the chip such as the operational mode of the liquid crystal controller driver 200, an index register IXR that stores index information for referring to the control register CTR and the display memory 206. When the external microcomputer or the like designates an executable instruction by writing it into the index register IXR, the control unit 201 generates a control signal corresponding to the instruction designated. The instructions that the control unit 201 executes are configured to be designated by a register selection signal RS, a write control signal WR, and 16-bit data bus signals DB0 to DB15, which are supplied from the outside.

By means of the control by the control unit 201 thus configured, the liquid crystal controller driver 200 executes displays on the liquid crystal panel not illustrated, on the basis of instructions and data from the microcomputer or the like. In that case, the liquid crystal controller driver 200 executes the drawing processing that sequentially writes image data into the display memory 206 as well as the reading processing that reads display data periodically from the display memory 206, and outputs to generate the signals to be applied to the source lines and the signals to be applied to the gate lines of the liquid crystal panel.

The system interface 204 transmits and receives between a system control device such as a microcomputer and the liquid crystal controller driver 200, signals such as setting data to the registers and display data that are required in writing image data into the display memory 206. In this embodiment, either of the parallel input/output or the serial input/output of 18 bits, 16 bits, 9 bits, and 8 bits as the 80-series interface is configured selectively according to the state of IM3–1 and IM0/ID terminals.

And, between the microcomputer and the system interface 204 are provided the control signal lines through which are transmitted a chip select signal CS* for selecting a chip for the data being transmitted to and a read enable signal RD* for accepting a readout and so forth, in addition to the register selection signal RS and the write control signal WR, and the data signal lines through which are transmitted and received 18-bit data signals DB0 to DB17 of the register setting data and the display data, etc.

Here, the data signals DB0 and DB1 of DB0 to DB17 and the serial data are designed to share the serial data communication line. The write control signal WR shares the input terminal to which a synchronizing serial clock SCL is inputted when the serial interface is specified, and the serial data are inputted/outputted to synchronize with the serial clock signal SCL. Selecting the serial interface will save the data signal lines for the data signals DB2 to DB17, and narrow the width of the system bus on the substitute.

Other than the above signals, the liquid crystal controller driver 200 of this embodiment inputs a reset signal RESET* for initializing the inside of the chip, test signals TEST1 and TEST2 for testing the internal circuits, and a test clock signal TSC and so forth. Other than the input/output terminals for these signals, the liquid crystal controller driver 200 of this embodiment provides the chip thereof with the terminals that output the voltages generated by the liquid crystal drive level generator 215 and the gradation voltage generator 216, and the terminals that input the control signals to the liquid crystal drive level generator 215, which are not directly related to this invention, and the descriptions thereof will be omitted.

When the liquid crystal controller driver 200 of this embodiment is applied to a system having two liquid crystal panels, one chip of the liquid crystal controller driver 200 is able to drive the two liquid crystal panels. If the two liquid crystal panels as the drive target have different characteristics, the γ adjustment circuit 217 is designed to be able to generate such gradation voltages as to correct the γ characteristics of each of the liquid crystal panels. To realize this, the liquid crystal controller driver 200 includes registers 221 and 222 for setting the γ characteristics of the two liquid crystal panels as the drive target, selects the register 221 or 222 holding the desired γ characteristic by means of the selector SEL3 during driving each of the liquid crystal panels, supplies the γ characteristic set in the register to the γ adjustment circuit 217, and dynamically varies the gradation voltages generated by the gradation voltage generator 216 by means of the control signal from the γ adjustment circuit 217. Instead of the registers 221, 222 retaining the γ characteristics, nonvolatile memory may be used as the setting means.

A signal MSC for switching the main screen and the sub-screen, which is outputted from the timing controller 203, controls the selector SEL3. The timing controller 203 varies the switching signal MSC during driving the main screen and during driving the sub-screen. The γ registers 221, 222 are configured such that the external microcomputer or the like is able to set through the system interface. These γ registers 221, 222 may also be included in the control register CTR.

Although it is not specified, the gradation voltage generator 216 is configured so as to generate gradation voltages V31 to V0 of 32 steps. The gradation voltage generator 216 includes, as an example shown in FIG. 8, a ladder-type resister 61 connected between power supply terminals Vcc and Vss, plural selectors 62 having switching devices that arbitrarily select voltages divided by the ladder-type resister 61, plural buffer amplifiers 63 that output to apply impedance conversions to the voltages selected by each selectors 62. Thereby, the gradation voltage generator 216 is able to output voltages of desired levels by switching the switching devices inside the selectors 62 by means of the set values in the two γ registers 221, 222. The gradation voltage generator 216 in FIG. 8 will attain an optimum picture quality by varying the set values in the γ registers 221 and 222 according to the γ characteristics of the liquid crystal panels being used. When the number of bits of the γ registers 221 and 222 are insufficient, a decoder may be provided on the post-stage of the selector SEL3.

Figure 8:
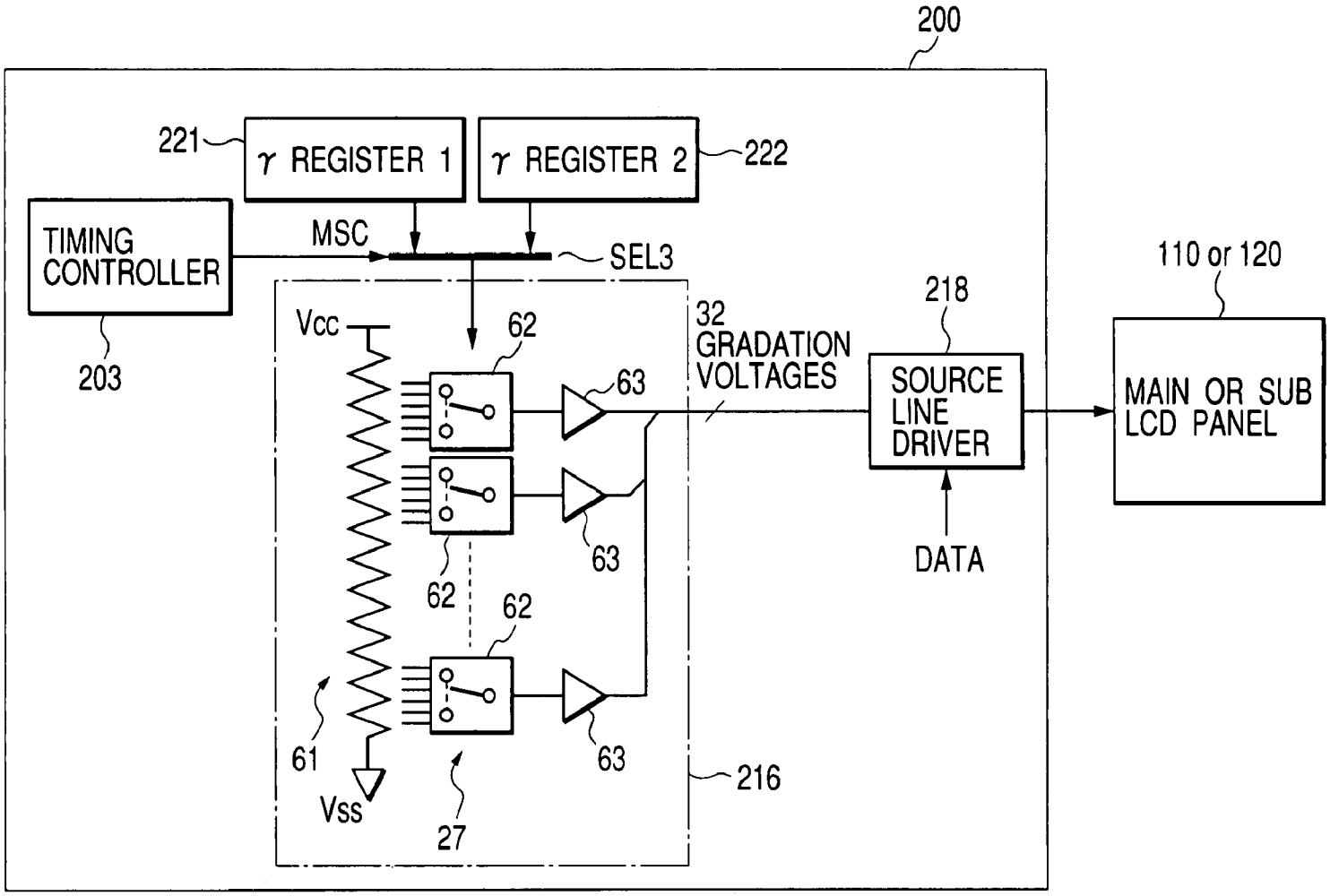
FIG. 8 is a block diagram illustrating a configuration of a gradation voltage generator being a constituent of the liquid crystal controller driver of the first embodiment.

The γ adjustment circuit 217 shown in FIG. 1 corresponds to the selectors 62 in FIG. 8. By means of the gradation voltages V31 to V0 of 32 steps generated by the gradation voltage generator 216, the source line driver 218 selects two adjacent voltages (for example, V21 and V22) each at the first half and latter half of one horizontal scan cycle to thereby generate substantially the medium voltage (V21+V22)/2, thus substantially realizing the gradation display of 64 steps.

Figure 2:
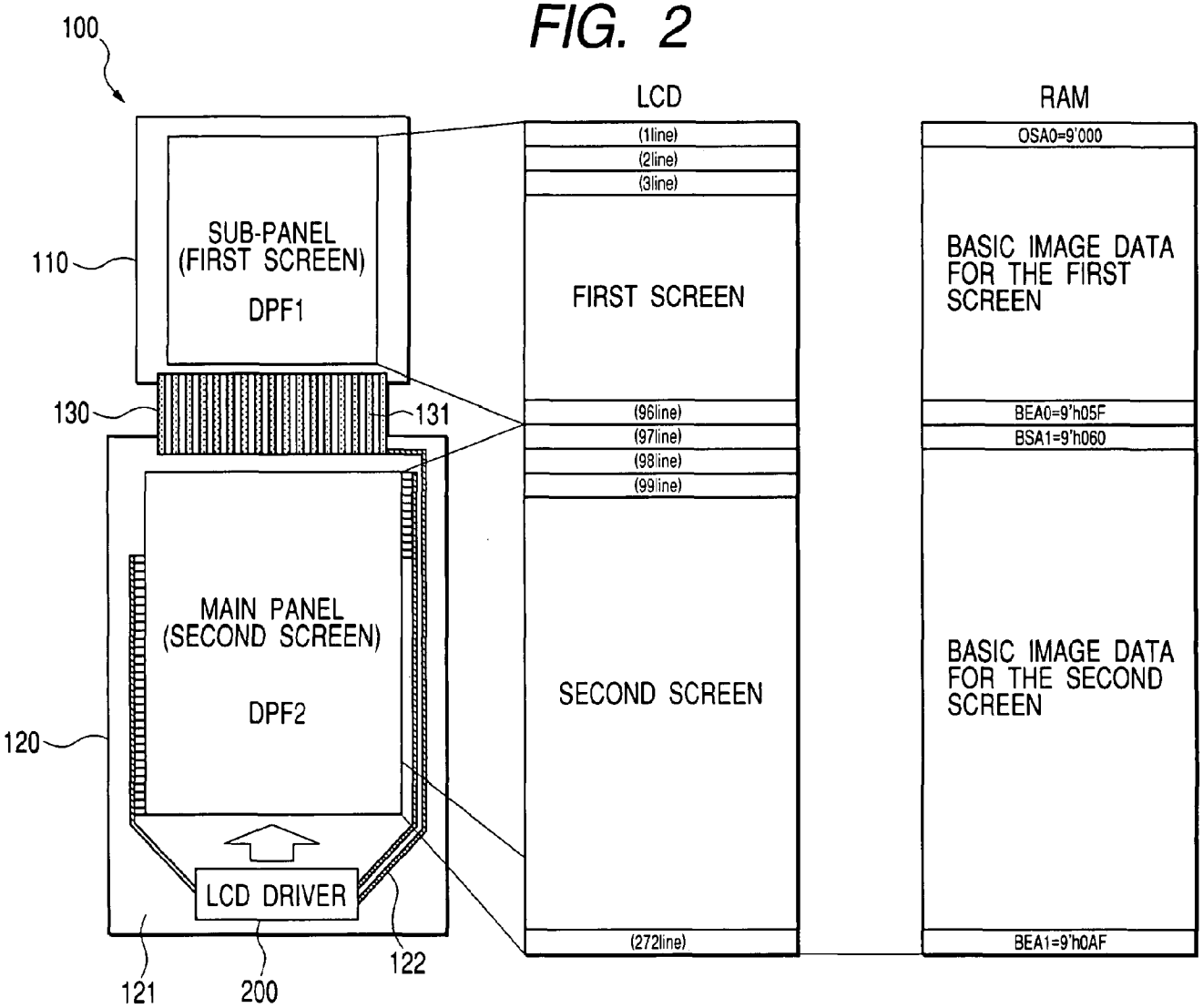
FIG. 2 is an explanatory chart illustrating a configuration of a liquid crystal display device that the liquid crystal controller driver of the first embodiment is able to drive, and the correspondence of display regions and image data storage regions in a display memory.
Figure 3:
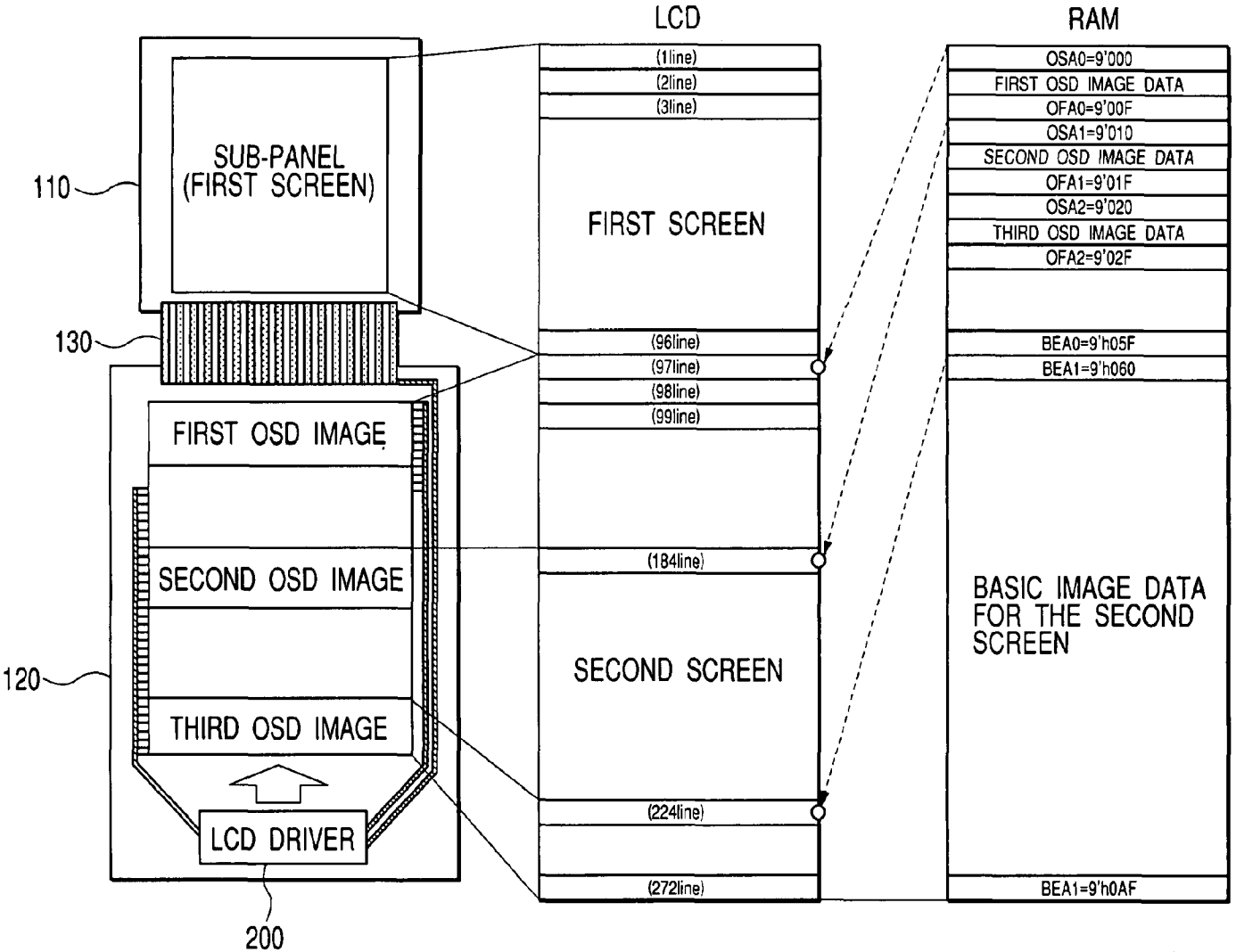
FIG. 3 is an explanatory chart illustrating the correspondence of display regions and image data storage regions, when a liquid crystal display device having two display panels displays a transparent image on one screen thereof.

FIG. 2 illustrates a configuration of a liquid crystal display device driven by the liquid crystal controller driver 200 of this embodiment. The liquid crystal display device 100 illustrated in FIG. 2 has two liquid crystal panels 110 and 120 coupled by a flexible printed cable 130 (generally called FPC). The liquid crystal controller driver 200 of this embodiment is mounted on a glass substrate 121 of one liquid crystal panel 120. Each source lines of the first liquid crystal panel 110 are connected in correspondence to each source lines of the second liquid crystal panel 120 by the wirings 131 on the FPC 130. Since the two liquid crystal panels 110 and 120 are coupled by the FPC 130, it will be possible to make such a configuration that bending the FPC 130 makes each backsides of the liquid crystal panels face to each other, and makes each display sides face in different directions by 180°.

When the liquid crystal panels 110 and 120 are a color liquid crystal panel, pixels configured with three dots of RGB (red, green, blue) are arrayed in matrix, RGB pixels are laid out sequentially repeatedly on each line (row), the same color pixels are arrayed in the column direction. The pixels of the liquid crystal panel are configured with switching devices made of TFT (Thin Film Transistor) and pixel electrodes, and voltages according to the image data are applied across the pixel electrodes and common electrodes facing to each other with the liquid crystal put in-between. And, the gate electrodes of the switching devices for the pixels on the same rows are formed continuously to make the gate lines, and the source terminals of the switching devices for the pixels on the same columns are connected to the source lines arranged in the crossing direction to the gate lines.

In the liquid crystal display device illustrated in FIG. 2, when it is applied to a folding type mobile telephone, for example, one display panel is located inside the upper lid to display a wait screen and the like with the lid open, and the other display panel is located outside the upper lid to usually display the time and the like, and to display an incoming call. In this type of mobile telephone, the inside screen to be seen with the upper lid open is essential, and the inside liquid crystal panel is made up with a high-definition color liquid crystal panel using TFTS, and in addition it is brightly displayed by backlighting in most cases. On the other hand, the backside screen to be seen with the lid closed is auxiliary, and a black-and-white display panel and a reflective display panel without backlighting are generally used in the outside liquid crystal panel to display such a screen.

In this manner, when the display qualities of the two liquid crystal panels are differentiated, it is a common exercise to use the liquid crystal panels having different γ characteristics. In case of driving two liquid crystal panels of the different characteristics as above, when transferring the drive mode of the liquid crystal panel from one liquid crystal panel to the other, the liquid crystal controller driver 200 of this embodiment switches the selector SEL3, and varies the set values in the registers 221 and 222 that are supplied to they adjustment circuit 217. Thereby, the gradation voltage generator 216 generates the gradation voltages of 32 steps that are different according to each of the characteristics of the panels, which are supplied to the source line driver 218, and the source line driver 218 selects the voltages according to the display data among these gradation voltages. Thus, the liquid crystal controller driver 200 is designed to generate the liquid crystal drive signals suitable for the characteristics of the panels, and is able to achieve optimum display qualities.

Further, the liquid crystal controller driver 200 of this embodiment includes registers BSA, BEA; OSA, OSE that set addresses (starting address and ending address) for specifying locations to write data inside the display memory 206, and a register ODP that sets the display position on the screen, etc., as shown in FIG. 1. The timing controller 203 is designed to generate the timing control signals on the basis of the set values in these registers. Although not illustrated in FIG. 1, the liquid crystal controller driver 200 of this embodiment also includes an enable register (see FIG. 4) that can set these registers BSA, BEA, OSA, OSE and ODP to be valid or invalid. The timing controller 203 also outputs to generate a frame synchronization signal FLM.

Here, the address setting registers BSA, BEA; OSA, OSE and the display position register ODP are shown near the timing controller 203, in FIG. 1 for illustration conveniences, however these registers are included inside the control reregister CTR of the control unit 201 in the liquid crystal controller driver 200 of this embodiment.

To provide two sets of the address setting registers is intended for enabling individual and arbitrary setting of the addresses that specify storage locations of basic image data served as the background, and of the addresses that specify storage locations of image data displayed to be overlapped with the background image data (hereunder, the latter image is called OSD image). There is provided one set of the display position registers ODP. This is because the display position of the basic image is fixed on the whole screen of the liquid crystal panel, and the display position of the OSD image is intended to be variable. When plural OSD images are desired for display, plural address registers OSA, OSE and plural display position registers ODP are to be provided.

In order that in a system having two liquid crystal panels, one liquid crystal controller driver drives the two liquid crystal panels to display basic images on each of the two liquid crystal panels, the liquid crystal controller driver 200 of this embodiment includes two sets of address setting registers for the basic images, that is, the starting register BSA0 for setting the starting address and the ending register BEA0 for setting the ending address of the first basic image, and the starting register BSA1 for setting the starting address and the ending register BEA1 for setting the ending address of the second basic image.

In order to display three OSD images at the same time, the liquid crystal controller driver 200 of this embodiment further includes three sets of address setting registers for the OSD images, that is, the starting register OSA0 for setting the starting address and the ending register OEA0 for setting the ending address of the first OSD image, the starting register OSA1 for setting the starting address and the ending register OEA1 for setting the ending address of the second OSD image, and the starting register OSA2 for setting the starting address and the ending register OEA2 for setting the ending address of the third OSD image. It also includes three display registers (ODP0, ODP1, ODP2) corresponding to the three OSD images.

The display memory 206 in the liquid crystal controller driver 200 of this embodiment possesses a sufficient capacity for storing image data, so as to display two basic images on the two display screens DPF1 and DPF2 of a display device having two liquid crystal panels as shown in FIG. 2. The display screen DPF1 corresponds to the liquid crystal panel 110, and the display screen DPF2 corresponds to the liquid crystal panel 120.

In case of making a transparent display on the liquid crystal panel 120 with the two images overlapped, the OSD image data are stored in the storage region of the image data corresponding to one (the first screen in the drawing) of the two display screens DPF1 and DPF2. When the OSD image data are stored in the storage region for the first screen, the drive control is implemented so as not to make a valid display (display of basic image) on the display screen DPF1 of the liquid crystal panel 110.

Reversely, in case of making a transparent display on the display screen DPF1 of the liquid crystal panel 110, and not making a display on the display screen DPF2 of the liquid crystal panel 120, the display memory 206 may be configured to store the basic image data in the image data storage region for the display screen DPF1, and to store the OSD image data in the image data storage region for the display screen DPF2.

In the mobile telephone, the display of the inside liquid crystal panel is essential in the state that the lid is open, and the display of the outside liquid crystal panel may be put off. On the other hand, the display of the outside liquid crystal panel is essential in the state that the lid is closed, and the display of the inside liquid crystal panel is to be put off in consideration for reducing the power consumption. Such storage management of the display memory 206 will enable a great variety of displays with a considerable small storage capacity. In other words, this embodiment will be able to reduce the storage capacity of the display memory that has to be prepared in advance, in comparison to the variety of display contents to be realized, which makes it possible to suppress an increase of the chip size of the liquid crystal controller driver 200.

Figure 4:
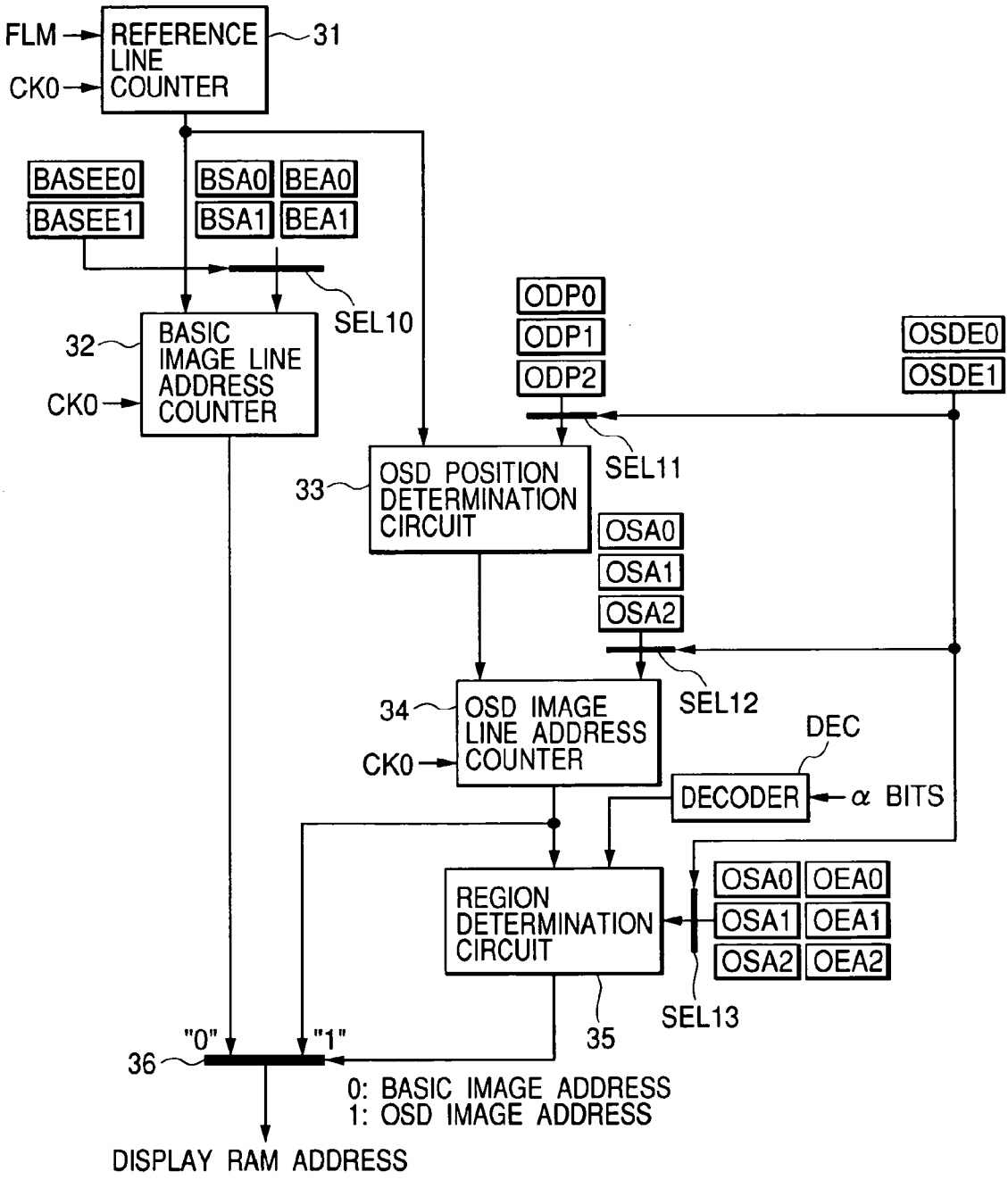
FIG. 4 is a block diagram illustrating a configuration of a read address generator contained in a timing controller inside the liquid crystal controller driver of the first embodiment.

FIG. 4 illustrates a configuration of a read address generator provided in the timing controller 203, in order to generate addresses for reading display data from the display memory 206.

As being shown in FIG. 4, the read address generator includes a reference line counter 31 that generates values to indicate the gate lines to which are applied the scan lines of the liquid crystal panel, namely, drive voltages, a basic image line address counter 32 that generates addresses for reading basic image data from the display memory 206, an OSD position determination circuit 33 that determines the display positions of OSD images, an OSD image line address counter 34 that generates addresses for reading OSD image data from the display memory 206, a region determination circuit 35 that determines whether it is a display region for the OSD image or not, and a selector 36 that selects either the counter value of the basic image line address counter 32 or the counter value of the OSD image line address counter 34 on the basis of the determination result of the region determination circuit 35, and outputs the selected counter value as the read address of the display memory.

The reference line counter 31 is reset to synchronize with the frame synchronization signal FLM, and is updated to synchronize with a reference clock CK0 having the cycle equivalent to one line cycle. The basic image line address counter 32 compares the value of the reference line counter 31 with the values of the starting register BSA0 for setting the starting address and the ending register BEA0 for setting the ending address of the first basic image, inside the control register CTR, and compares the value of the reference line counter 31 with the values of the starting register BSA1 for setting the starting address and the ending register BEA1 for setting the ending address of the second basic image, inside the control register CTR; when the value of the reference line counter 31 is between the values of the starting and ending address registers of the first basic image, and is between the values of the starting and ending address registers of the second basic image, the basic image line address counter 32 updates the addresses to synchronize with switching the display line.

Although it is not restricted, the read address generator in FIG. 4 includes enable registers BASEE0, BASEE1 that set the address setting registers BSA0, BEA0; BSA1, BEA1 to be active or inactive, and a selector SEL10 used both as a gate that passes through or cuts off the values of the registers BSA0, BEA0; BSA1, BEA1.

The OSD position determination circuit 33 compares the value of the reference line counter 31 with the set values of the display position registers ODP0, ODP1, ODP2 inside the control register CTR, and determines whether or not the display line reaches the display starting position of the OSD image; when it does, the OSD position determination circuit 33 makes the OSD image line address counter 34 load the values of the starting registers OSA0, OSA1, OSA2 of the OSD image inside the control register CTR, and then updates the addresses to synchronize with switching the display line.

The region determination circuit 35 compares the values of the starting registers OSA0, OSA1, OSA2 and the ending registers OEA0, OEA1, OSE2 of the OSD image inside the control register CTR with the values of the OSD image line address counter 34, and determines whether or not the display line is inside the display region of the OSD image. Also, the region determination circuit 35 switches the selector 36 on the basis of the output from the decoder DEC that decodes α bits indicating the transparency contained in the OSD image data read from the display memory 206, and makes the selector 36 output either the counter value of the basic image line address counter 32 or the counter value of the OSD image line address counter 34 as the read address of the display memory.

Although it is not restricted, the read address generator in FIG. 4 includes enable registers OSDE0, OSDE1 that set the display position registers ODP0, ODP1, ODP2, the starting registers OSA0, OSA1, OSA2 of the OSD image, and the ending registers OEA0, OEA1, OSE2 of the OSD image to be active or inactive, and selectors SEL11, SEL12, SEL13 used both as gates that pass through or cut off the values of the registers ODP0, ODP1, ODP2, the registers OSA0, OSA1, OSA2, and the registers OEA0, OEA1, OSE2.

The read address generator in FIG. 4 controls the switching of the selector 36, when the α bits indicate the transparent display, such that the selector 36 outputs the counter value of the OSD image line address counter 34 in the half cycle of one line display cycle of the liquid crystal panel, and the counter value of the basic image line address counter 32 in the latter cycle thereof. When the α bits indicate the 100% display of the basic image, the read address generator controls the switching of the selector 36 to output the counter value of the basic image line address counter 32 throughout the one line display cycle of the liquid crystal panel; when the α bits indicate the 100% display of the OSD image, the read address generator controls the switching of the selector 36 to output the counter value of the OSD image line address counter 34 throughout the one line display cycle of the liquid crystal panel.

Further, when the α bits indicate the blinking, the read address generator controls the switching of the selector 36 to alternately output the counter value of the basic image line address counter 32 and the counter value of the OSD image line address counter 34, with a considerably long period of 0.5 or 1 second. Table 1 shows the relations between the display contents and the α bits of 3 bits in the liquid crystal controller driver 200 of this embodiment.

TABLE 1

| α2 | α1 | α0 | Contents of display |
|---|---|---|---|
| 0 | 0 | 0 | 100% display of basic image data |
| 0 | 0 | 1 | — |
| 0 | 1 | 0 | — |
| 0 | 1 | 1 | — |
| 1 | 0 | 0 | Basic image data, OSD image data, 50% transparent display |
| 1 | 0 | 1 | Blinking display of basic image data and OSD data 1 |
| 1 | 1 | 0 | 100% display of OSD image data |
| 1 | 1 | 1 | Blinking display of basic image data and OSD data 2 |

Figure 5:
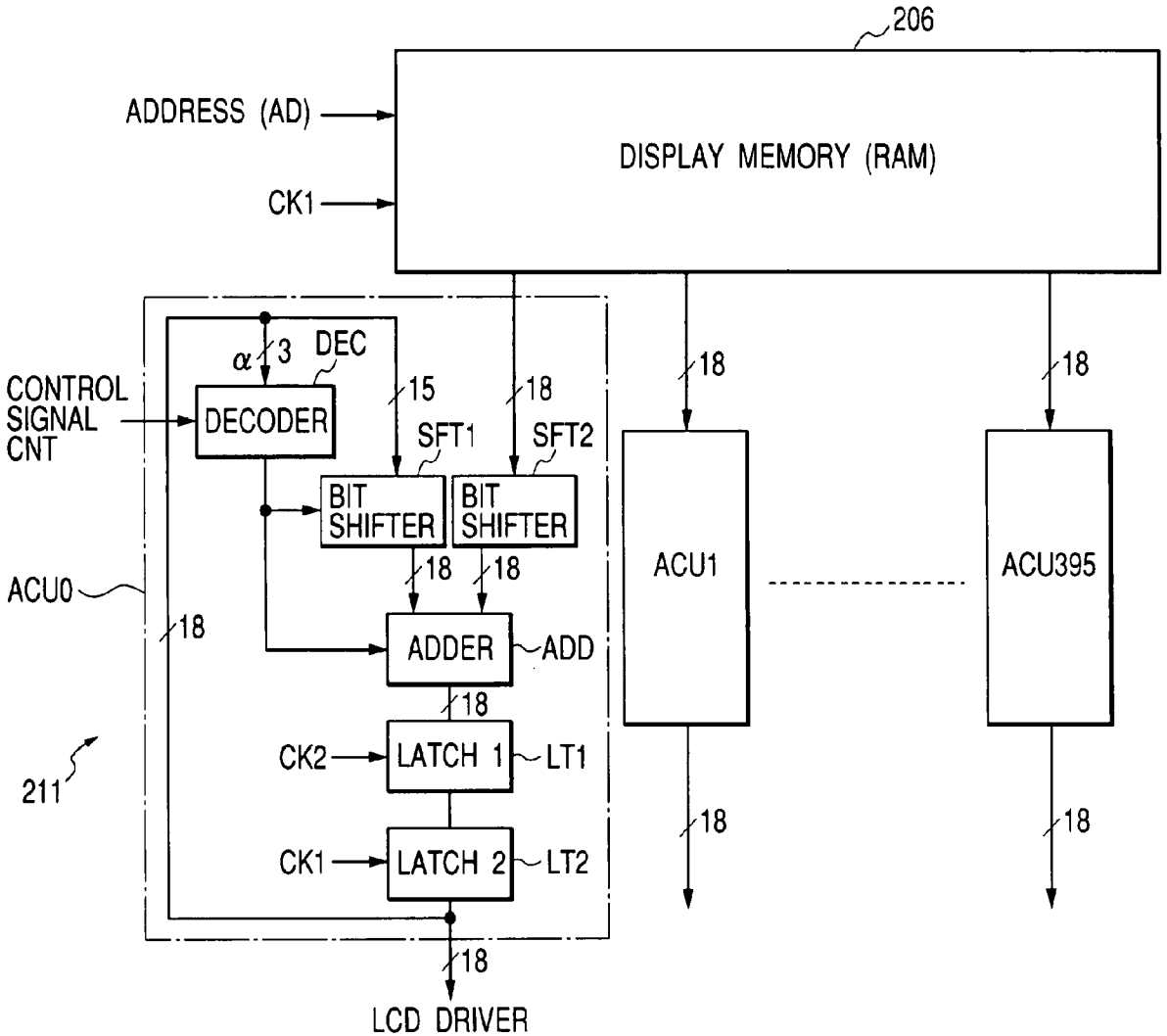
FIG. 5 is a block diagram illustrating a configuration of a transparency arithmetic circuit provided in the post-stage of the display memory inside the liquid crystal controller driver of the first embodiment.
Figure 6:
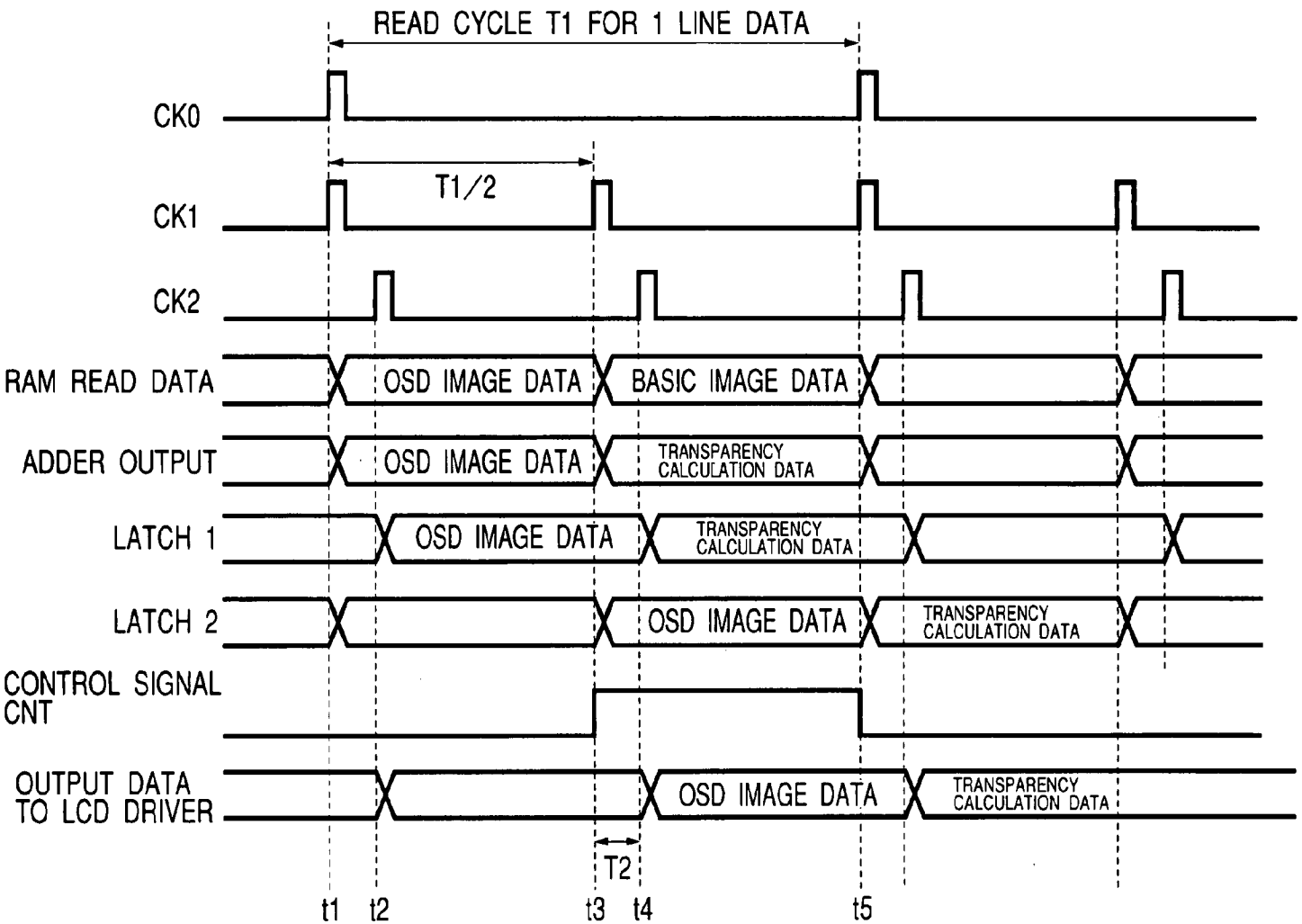
FIG. 6 is a timing chart illustrating the timings of signals in the transparency arithmetic circuit of the first embodiment.

FIG. 5 illustrates a configuration of the transparency arithmetic circuit 211, and FIG. 6 illustrates the operational timing thereof.

This embodiment is configured such that the display data for one line, namely, 396 pixels of the liquid crystal panel are read out simultaneously from the display memory 206. The display data read out are configured with 6 bits each for one pixel of RGB, 18 bits in total, and the transparency arithmetic circuit 211 is provided with 396 unit arithmetic circuits ACU0 to ACU395 corresponding to the display data for 396 pixels. FIG. 5 illustrates the configuration of the ACU0 as a concrete example, out of the unit arithmetic circuits ACU0 to ACU395. Although not illustrated, the other unit arithmetic circuits ACU1 to ACU395 have the same configuration. Hereunder, the unit arithmetic circuit ACU0 will be explained, and the explanation of the other unit arithmetic circuits ACU1 to ACU395 will be omitted.

The unit arithmetic circuit ACU0 includes two bit shifters SFT1, SFT2, an adder ADD that adds 18-bit data processed by these bit shifters SFT1, SFT2, a first latch LT1 that temporally holds the output of the adder ADD, a second latch LT2 that fetches the output of the latch LT1, and a decoder DEC that decodes the α bits of three bits indicating the transparency of the display data fetched by the latch LT2, and generates a control signal to the bit shifters SFT1, SFT2 and the adder ADD. The latch LT1 synchronizes with a clock signal CK2, and the latch LT2 synchronizes with a clock signal CK1 having the same cycle and different phase with the clock signal CK2. The clock signal CK1 is generated through the frequency dividing of the reference clock CK0.

The bit shifter SFT1 inputs the display data of 18 bits read out from the display memory 206, and the bit shifter SFT2 inputs the display data fetched in the second latch LT2. The bit shifters SFT1, SFT2 are each controlled to perform either one-bit shifting operation or non-shifting operation to the display data of 18 bits in accordance with the output of the decoder DEC. The one-bit shifting operation shifts the upper bits by one bit to the lower bits. Accordingly, the one-bit shifting operation results in extinction of the LSB of 18-bit image data. The adder ADD is designed, in the one-bit shifting operation, to add the lower 5 bits of the 6 bits of RGB supplied from the bit shifter SFT1 and the lower 5 bits supplied from the bit shifter SFT2 in accordance with the output of the decoder DEC.

The unit arithmetic circuit ACU0 is designed, when the decoder DEC is made inoperative by a control signal CNT thereto, such that the bit shifter SFT1 passes through the display data inputted from the display memory 206, and the adder ADD passes through the display data inputted from the bit shifter SFT1. When the decoder DEC is in the inoperative state, instead of putting the adder ADD into the through state, it may be designed such that the bit shifter SFT2 cuts off the inputs and outputs data of all "0", and the adder ADD adds the data of all "0" and the display data inputted from the bit shifter SFT1 to output the result. The control signal CNT to the decoder DEC is supplied from the timing controller 203.

This embodiment is designed to read out the basic image data and the OSD image data from the display memory 206 by the time-division system; still conceivable is a system that reads out the basic image data and the OSD image data simultaneously. However, the system reads out the basic image data and the OSD image data from the display memory 206, even when the transparency processing is not executed; and the system needs a mechanism to intercept unnecessary image data accordingly. And, if the system is applied to such a case that the probability of the transparency processing being not executed is higher than that of the transparency processing being executed, it will increase an unnecessary waste of power consumption due to unnecessary readout operations. Therefore, the system of this embodiment that reads out the basic image data and the OSD image data by the time-division system has more possibility of building up a circuit that needs less power consumption in total.

Next, the operation of the transparency arithmetic circuit 211 will be described with reference to the timing chart in FIG. 6.

In the liquid crystal controller driver 200 of this embodiment, the execution of the α blending involves reading out the OSD data first, and then reading out the basic image data. The clock signals CK1, CK2 that operate the transparency arithmetic circuit 211 are set to ½ cycle of one line display cycle T1 of the liquid crystal panel, and the control signal CNT that controls the decoder DEC to decode the α bits is set to the inactive level (Low level) at the first half of the one line display cycle, and is set to the active level (High level) at the latter half.

In the timing chart of FIG. 6, as an OSD image data is read out from the display memory 206 to synchronize with the clock signal CK1 at timing t1, the OSD image data passes through the bit shifter SFT1 and the adder ADD to be latched by the latch LT1 to synchronize with the clock signal CK2 at timing t2. The OSD image data latched by the latch LT1 is latched by the latch LT2 to synchronize with the next pulse of the clock signal CK1 at timing t3.

At this moment, a basic image data as the next display data is read out from the display memory 206. And, the latch LT2 latches the OSD image data containing the α bits. As the control signal CNT is changed into the high level to synchronize with the rise of the clock signal CK1, the decoder decodes the α bits and activates the bit shifters SFT1, SFT2. Thereby, the bit shifters SFT1, SFT2 execute the bit shifting processing to the basic image data and OSD image data, and the adder ADD adds the two image data thus bit-shifted to output the result (transparency arithmetic data) during a period T2 in FIG. 6.

The transparency arithmetic data outputted from the adder ADD is latched by the latch LT1 to synchronize with the clock signal CK2 at time t4. The transparency arithmetic data latched by the latch LT1 is latched by the latch LT2 to synchronize with the next pulse of the clock CK1 at timing t5, and is supplied to the liquid crystal driver (dc/ac converter and source line driver).

This embodiment explains a case, in which the bit shifters SFT1, SFT2 execute one-bit shifting to thereby generate 50% transparency image data through the α blending. It is still possible to generate image data of 25% and 75% transparency by adding a path that allows the data retained in the latch LT2 to be fed back to the bit shifter SFT1 and a path that allows the data to be fed back to the adder ADD.

When the α bits of the OSD image data read out from the display memory indicate 75% transparency at the first half of one line display period, for example, before the basic image data is read out from the display memory, the OSD image data being latched in the latch LT1 is supplied to the bit shifter SFT2 to execute one bit shifting, and is latched as a 50% transparency data in the latch LT2. Thereafter, the OSD image data is supplied again to the bit shifter SFT2 to execute one bit shifting at the second time, and is latched as a 25% transparency data in the latch LT1. And, the 25% transparency data in the latch LT1 and 50% transparency data in the latch LT2 are supplied to the adder ADD to attain the OSD image data of 75% transparency. Thereafter, the basic image data read out from the display memory is passed through the bit shifter SFT1 twice to generate a basic image data of 25% transparency, and the adder ADD adds the basic image data of 25% transparency and the OSD image data of 75% transparency to output the result.

In the same manner, generating the OSD image data of 25% transparency first, then generating the basic image data of 75% transparency, and adding these data makes it possible to output the image data of 25% transparency. Here, the bit shifters SFT1, SFT2 may be configured to perform two-bit shifting or three-bit shifting at one time according to the output from the decoder DEC. This will shorten the time for generating the image data of 75% or 25% transparency.

Now, an example of the data format of the basic image data and OSD image data in the liquid crystal controller driver 200 of the first embodiment will be explained with reference to FIGS. 7(A) to 7(C).

The basic image data and the OSD image data are each configured with 18 bits. With regard to the basic image data, each colors of RGB are represented with 6 bits, as illustrated in FIG. 7(A). With regard to the OSD image data, each colors of RGB are represented with 5 bits, and when the data inputted from the outside of the chip takes on the data format having α bits α2, α1, α0 arranged at the leading 3 bits as shown in FIG. 7(B), or the data format having α bits α2, α1, α0 allocated each at the least significant bits of each colors of RGB as shown in FIG. 7(C), any of them is made acceptable. And, if the data of the data format as FIG. 7(B) is inputted, the bit processor 207 (BGR circuit in FIG. 1) inside the chip converts the arrangement of the bits into that of FIG. 7(C), and the converted is stored in the display memory 206. The instruction to input the data designates either of the data formats shown in FIG. 7(B) and FIG. 7(C), which the inputted image data bears.

As already mentioned, the liquid crystal controller driver 200 of this embodiment is configured such that in case of driving two liquid crystal panels of different characteristics, the gradation voltage generator 216 is able to generate the gradation voltages different according to each of the characteristics of the panels, when transferring the drive state of the liquid crystal panel from one liquid crystal panel to the other. And, the liquid crystal controller driver 200 includes the two registers 221 and 222 and the selector SEL3 in order to switch the gradation voltages. However, in such a system as this embodiment that the selector SEL3 switches the set values in the registers 221 and 222 to supply the selected one to the γ adjustment circuit 217, the output voltage does not rise swiftly due to a response lag of the gradation voltage generator 216, and there is the apprehension that the image quality deteriorates during the switching. The response lag of the gradation voltage generator 216 is caused mainly by the delay in the buffer amplifiers 63 of the gradation voltage generator 216.

Figure 9A:
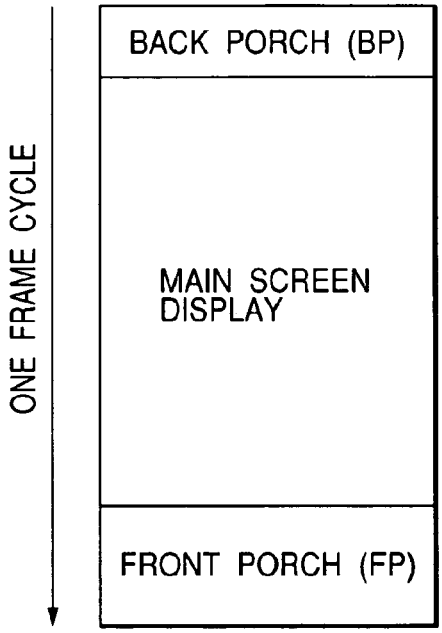
FIGS. 9(A) and 9(B) are explanatory charts illustrating the display timings of screens on the liquid crystal panels driven by a conventional liquid crystal controller driver and the liquid crystal controller driver having the first embodiment applied thereto.
Figure 9B:
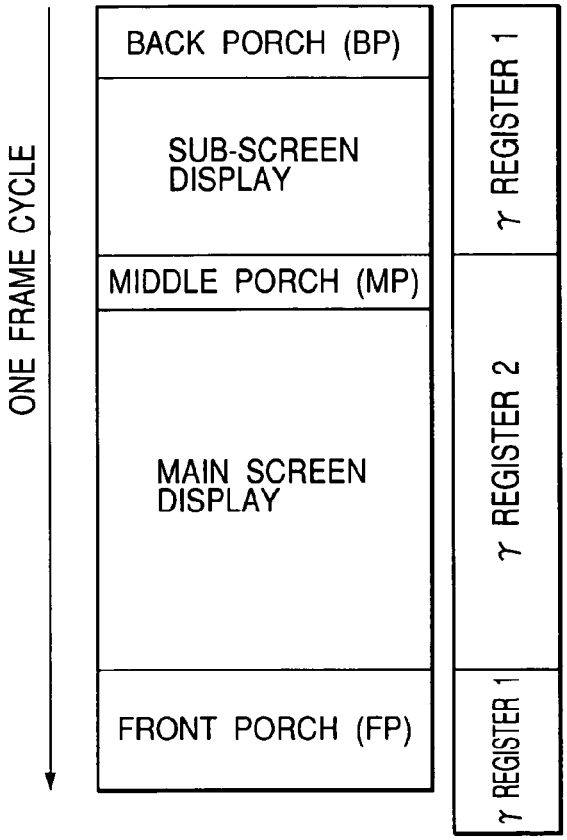

Accordingly, this embodiment adjusts the timing of the signal outputted from the timing controller 203 to thereby provides for a time lag (hereunder, called middle porch MP) as shown in FIG. 9(B), when the display transfers from the screen on one panel to the screen on the other panel, and controls so as not to apply the voltages to any of the gate lines during the period of this middle porch MP to thereby prevent deterioration of the display quality. FIG. 9(A) illustrates the operation in the conventional one screen drive, and FIG. 9(B) typically illustrates the operation, when the liquid crystal controller driver 200 of this embodiment drives the display to transfer from the sub-screen on the first liquid crystal panel 110 to the main screen on the second liquid crystal panel 120.

As shown in FIG. 9(B), this embodiment selects the γ register 1 (221) to generate a gradation voltage based on the set value during display of the sub-screen, and selects the γ register 2 (222) to generate a different gradation voltage based on the set value during display of the main screen. The switching from the γ register 1 to the γ register 2 is carried out during the period of the middle porch MP. Further, the embodiment provides for the interval FP called front porch from the beginning as the fly-back time when returning the display from the main screen to the sub-screen, and the interval BP called back porch; the embodiment switches the register from the γ register 2 to the γ register 1 during this interval to perform the switching of the gradation voltages. By means of the above control, the embodiment realizes transferring the drive from the liquid crystal panel 110 to 120 and from 120 to 110, each having different characteristics, without inviting deterioration of display quality.

Figure 10:
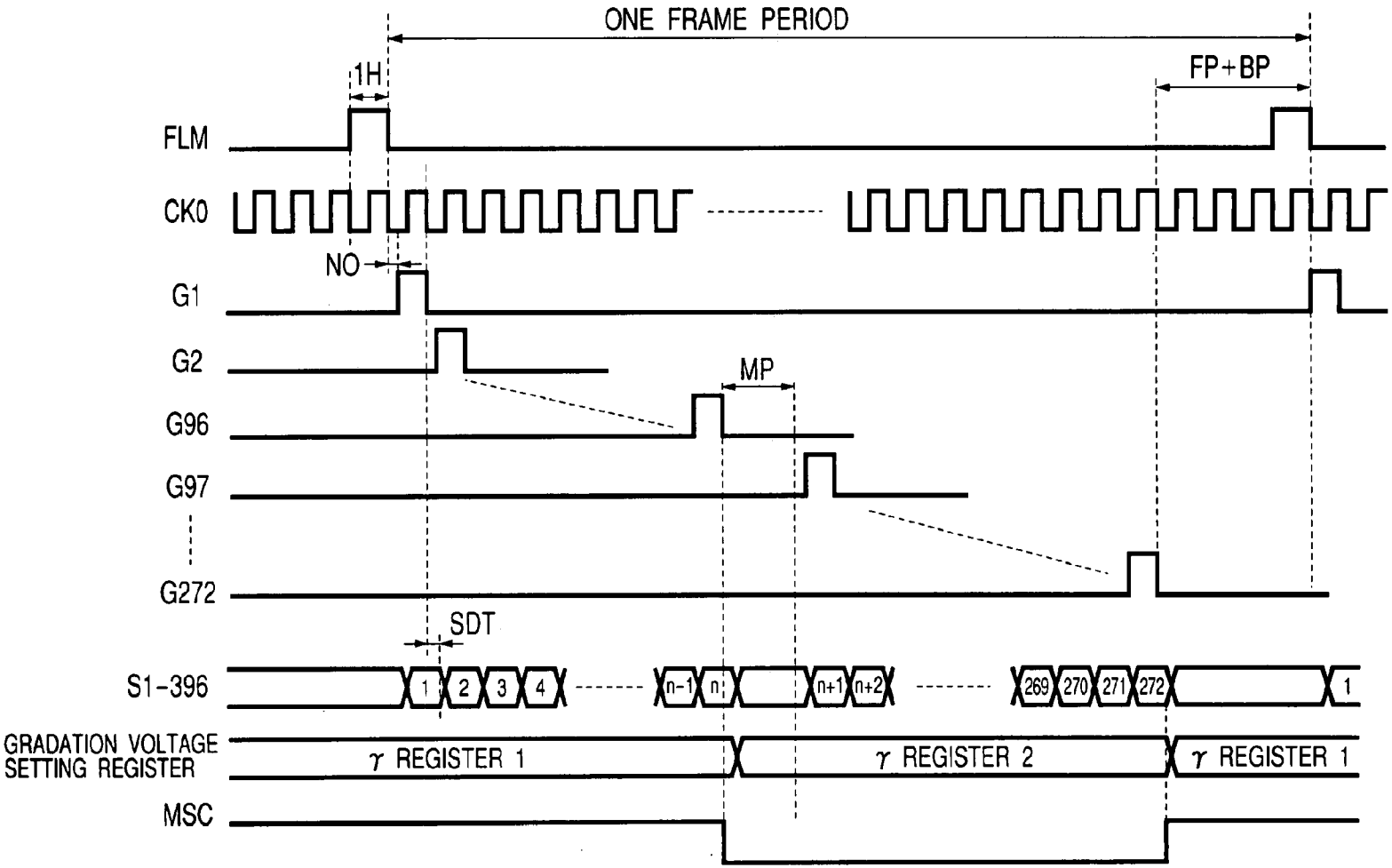
FIG. 10 is a timing chart illustrating the drive timings of display screens on the two liquid crystal panels driven by the liquid crystal controller driver having the first embodiment applied thereto.

FIG. 10 illustrates the timing chart of the gate line drive signals G1 to G272, when executing the display switching control provided with the middle porch. In FIG. 10, the symbol FLM signifies the frame synchronization signal, CK0 the reference clock signal, G1 to G96 the drive signals of the gate lines for the first panel that present the sub-screen, G97 to G272 the drive signals of the gate lines for the second panel that present the main screen, S1 to S396 the drive signals of the source lines common to the first panel and the second panel, and MSC the switching signal of the main screen and sub-screen. The drive signals S1 to S396 of the whole source lines are simultaneously outputted, and the switching is carried out to synchronize with the gate line drive signals G1 to G272. As shown in FIG. 10, the middle porch MP is given between the gate line drive signals G96 and G97, the front porch FP and back porch are given between the gate line drive signals G272 and G1. During these intervals, the switching signal MSC switches the selector SEL3 to select the set values in the γ registers.

As mentioned above, providing for the middle porch when switching the display screens makes it possible to transfer the display drive from the liquid crystal panel 120 to 110, having different characteristics, without inviting reduction of the display quality. Since the above embodiment takes on the system that selects the set values in the two γ registers 221, 222 to give the selected to one gradation voltage generator 216, when the set values are switched, the buffer amplifiers 63 create a response lag.

Accordingly, conceivable is a system that prepares for two gradation voltage generators corresponding to different γ characteristics. In such a system, switching the outputs of the two gradation voltage generators corresponding to the display panel will significantly shorten the response lag. However, the provision of the two gradation voltage generators will extremely expand the circuit scale, which is very disadvantageous. In contrast to this, the embodiment takes on one gradation voltage generator, and switches the generation voltages by the set values in the γ registers, which makes it possible to minimize expansion of the circuit scale.

Further, it is conceivable to provide a part of the control register CTR with a register that designates the interval of the middle porch MP, and to make the timing controller 203 variably control the interval of the middle porch MP according to the set values in this register. In this case, if it is configured to variably control the interval of the middle porch MP by one horizontal cycle, namely, the integral multiple of the cycle of the reference clock CK0, it will be possible to vary the interval of the middle porch MP by a considerably simple circuit. It is conceivable that about 7 horizontal cycles at maximum are sufficient for the interval of the middle porch, although it depends on the gradation voltage generator and the characteristics of the liquid crystal panels.

Figure 11:
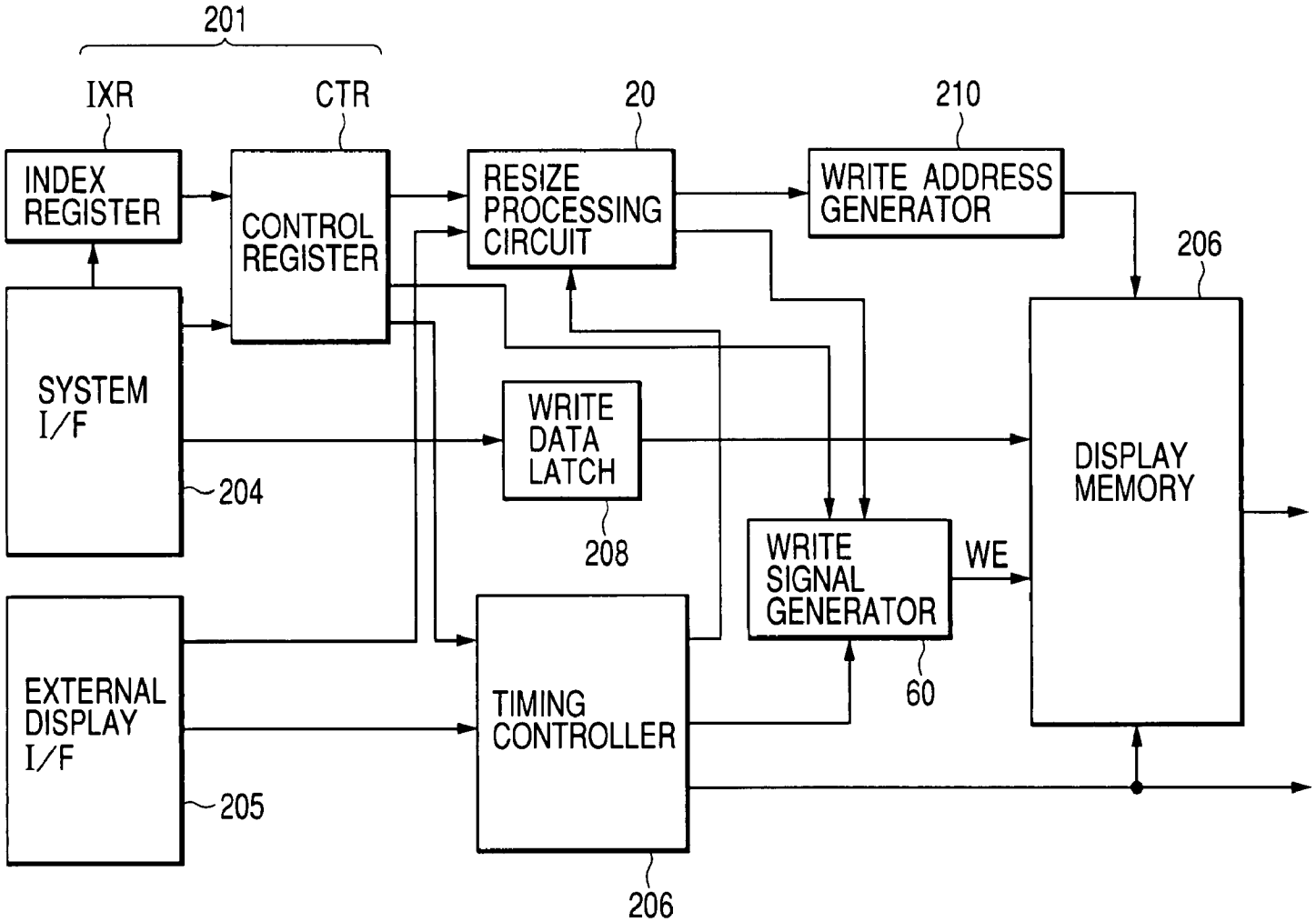
FIG. 11 is a block diagram illustrating a circuit configuration of a write system of the liquid crystal controller driver having the second embodiment applied thereto.

Next, the second embodiment will be described with reference to FIG. 11 through FIG. 16. The second embodiment provides the liquid crystal controller driver 200 with the resizing function that reduces an input image into ½, ⅓, . . . , in addition to the α blending function and so forth of the first embodiment. In concrete, the liquid crystal controller driver of the second embodiment possesses a resizing processing circuit 20 in the pre-stage of the write address generator 210 as shown in FIG. 11. And, the control register CTR of the control unit 201 contains a resizing register RSZ for setting the reduction rate in the resizing processing circuit 20, and remainder registers RCV, RCH for setting the number of pixel remainders in the vertical direction and horizontal direction. Although it is not specified, the resizing register RSZ of this embodiment is provided with the bits for setting the locations of pixels to be thinned, in addition to the bits for setting the reduction rate.

Other than the resizing processing circuit 20, resizing register RSZ, and remainder registers RCV, RCH, the liquid crystal controller driver of the second embodiment may take on the same configuration as illustrated in FIG. 1. FIG. 11 illustrates only the circuits involved in writing related to the second embodiment, of the circuit block shown in FIG. 1, which omits the circuits involved in reading. A write signal generator 60, which is not illustrated in FIG. 1, and is illustrated in FIG. 11, is a circuit that generates a write enable signal WE for writing data into the display memory 206, which is contained in the timing controller 206.

Figure 12:
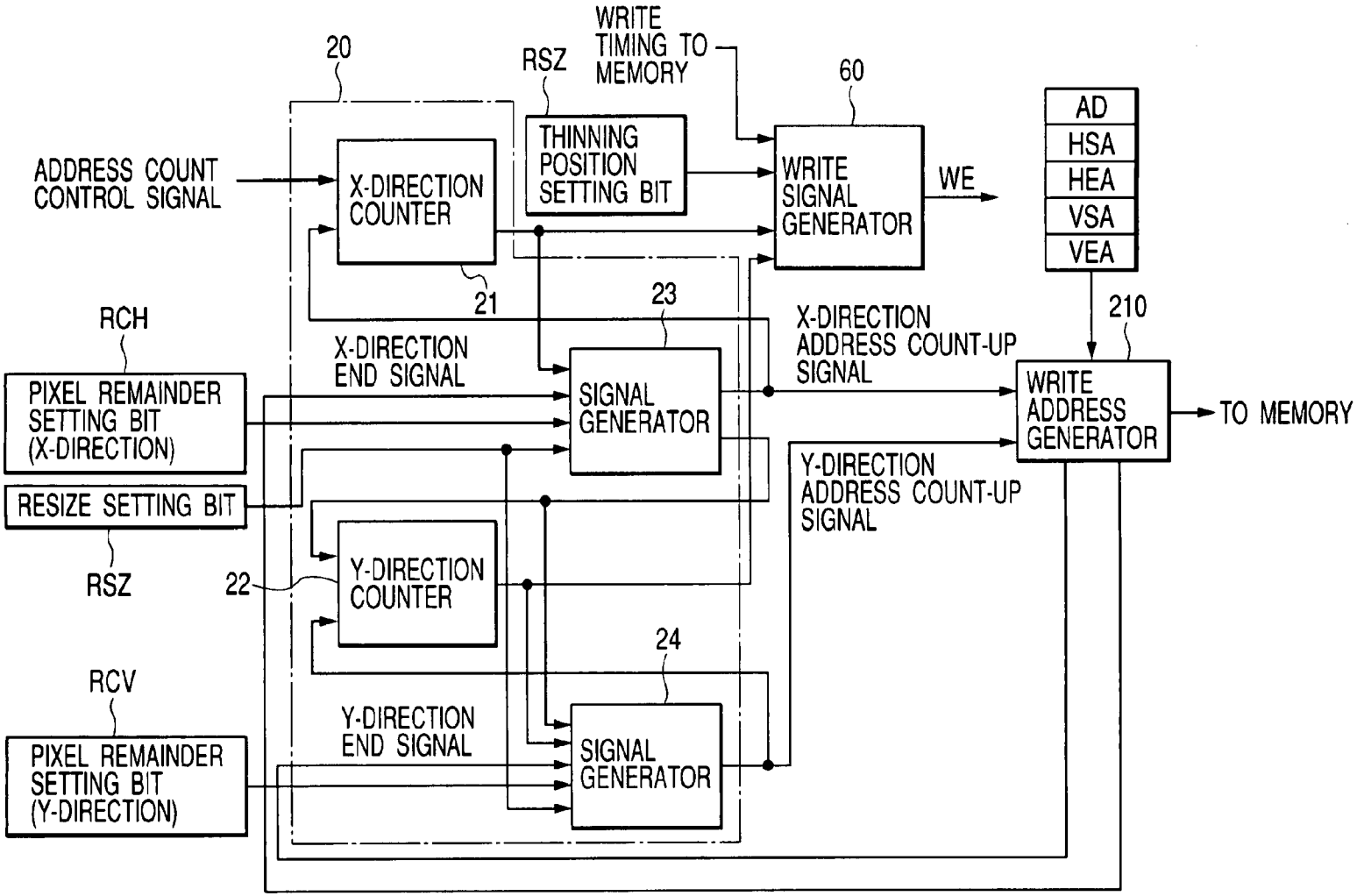
FIG. 12 is a block diagram illustrating a configuration of a resizing processing circuit being a constituent of the liquid crystal controller driver having the second embodiment applied thereto.

FIG. 12 illustrates a concrete configuration of the resizing processing circuit 20.

The resizing processing circuit 20 includes an X-direction counter 21 that counts addresses in the X-direction, namely, line direction, a Y-direction counter 22 that counts addresses in the Y-direction, namely, column direction, a signal generator 23 that generates a reset signal to the X-direction counter 21 and a clock signal to the Y-direction counter 22, and a signal generator 24 that generates a reset signal to the Y-direction counter 22.

The X-direction counter 21 counts up based on an address count control signal (clock signal) supplied from the timing controller 206, is reset by the reset signal from the signal generator 23, and repeats counting of predetermined values. The address count control signal is generated based on the write control signal WR supplied from the outside of the chip and so forth. The signal generator 23 generates the reset signal to the X-direction counter 21 and the clock signal to the Y-direction counter 22, on the basis of a count-up signal from the X-direction counter 21, an X-direction ending signal from the write address generator 210, an X-direction remainder setting bit signal from the remainder register RCH, and a reduction rate setting signal from the resizing register RSZ.

The Y-direction counter 22 counts up based on the clock signal from the signal generator 23, is reset by the reset signal from the signal generator 24, and repeats counting of predetermined values. The signal generator 24 generates the reset signal to the Y-direction counter 22, on the basis of a count-up signal from the Y-direction counter 22, a Y-direction ending signal from the write address generator 210, a Y-direction remainder setting bit signal from the remainder register RCH, and a reduction rate setting signal from the resizing register RSZ. The reset signal to the X-direction counter 21 and the reset signal to the Y-direction counter 22 are supplied also to the write address generator 210 to update the address counter inside thereof.

The write address generator 210 generates write addresses to the display memory 206, by looking up an address register AD for setting write starting positions and registers HSA, HEA, VSA, VEA for holding window addresses indicating write regions, which are provided in the control register CTR. The address register AD for setting write starting positions and the window address registers HSA, HEA, VSA, VEA are the registers, which can be used in case of writing a smaller image than the basic image in an arbitrary position of the display memory 206 to execute an overlapped display.

The count-up signal from the X-direction counter 21 and the count-up signal from the Y-direction counter 22 are supplied to the write signal generator 60. The write signal generator 60 is configured to generate the write enable signal WE on the basis of these signals, a write timing signal from the timing controller 203, and the bit signal for setting the locations of thinned pixels from the resizing register RSZ.

Figure 14B:
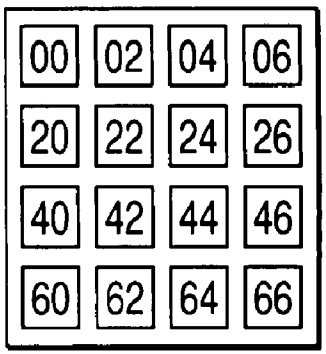
FIG. 14(B) is an explanatory chart illustrating an image of reduced image data.
Figure 14A:
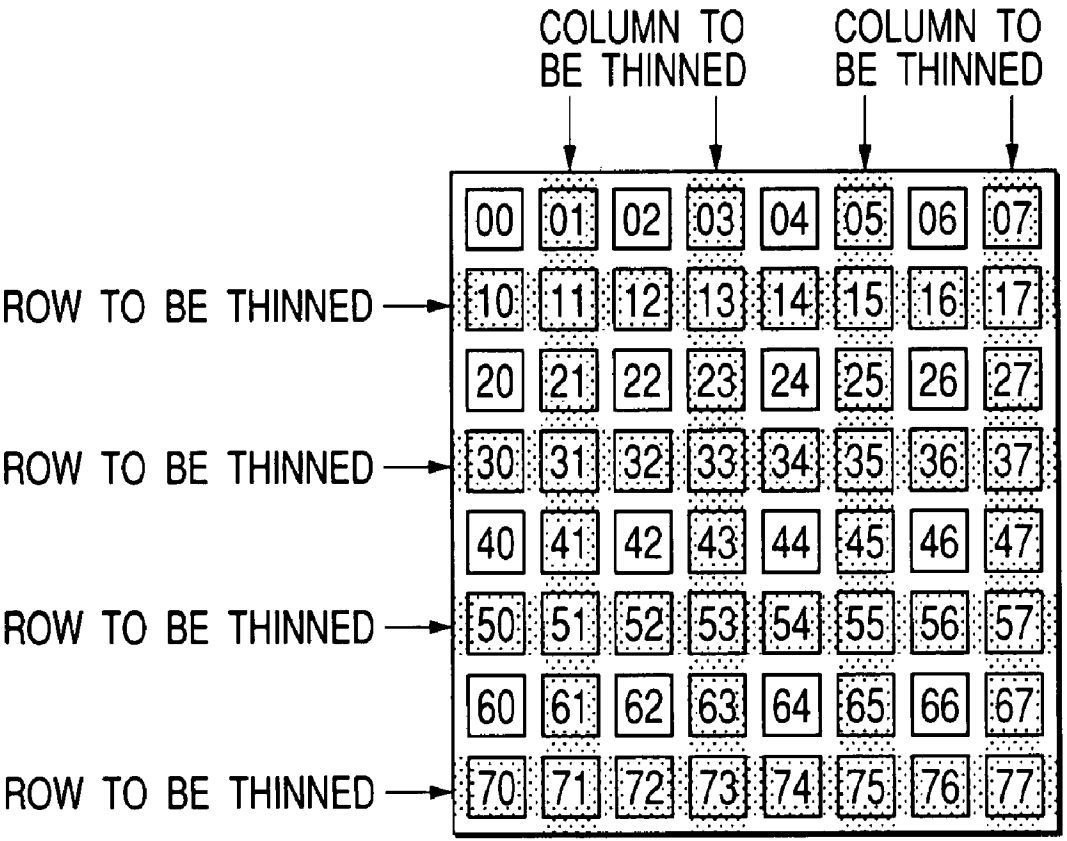
FIG. 14(A) is an explanatory chart illustrating the principle of the resizing processing of the second embodiment.

Now, the principle of the image reduction processing by the resizing processing circuit 20 in FIG. 12 will be explained with FIGS. 14(A) and 14(B) and FIGS. 15(A) to 15(D). FIGS. 14(A) and 14(B) illustrate a case of ½ reduction, and FIGS. 15(A) to 15(D) a case of ⅓ reduction. Cases of ¼ reduction and ⅕ reduction, etc., are on the same principle, though not illustrated. The bits for setting the reduction rate in the resizing register RSZ designate these reduction rates.

The resizing processing circuit 20 of this embodiment thins a write image data at a predetermined rate as shown in FIG. 14(A), and thereby obtains a reduced image as shown in FIG. 14(B) to write this reduced image in a designated region inside the display memory 206. Although FIG. 14(A) illustrates an example of thinning even rows and even columns, to thin odd rows and odd columns will attain a reduced image as well. The rows and columns to be thinned are made specifiable by the bits for setting the locations of thinned pixels inside the resizing register RSZ.

Figure 15A:
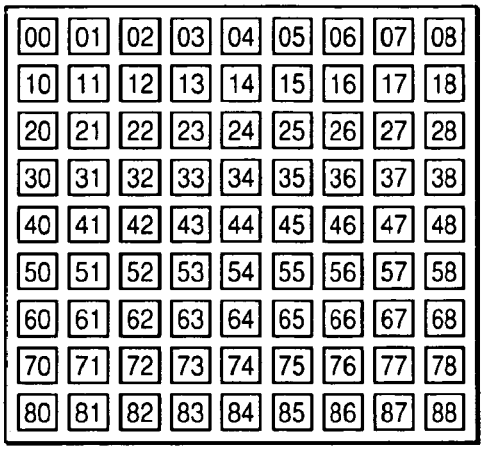
FIGS. 15(A) to 15(D) are explanatory charts illustrating three patterns of ⅓ reduction by the resizing processing of the second embodiment.
Figure 15B:
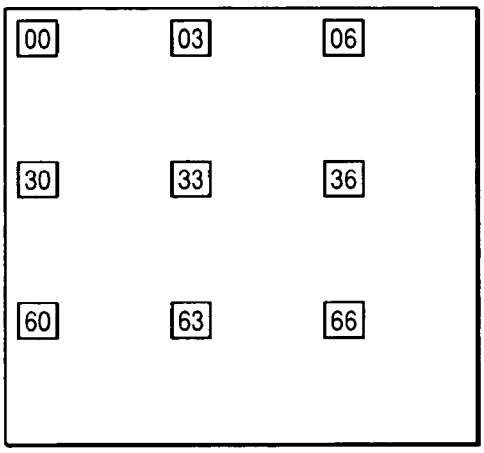
Figure 15C:
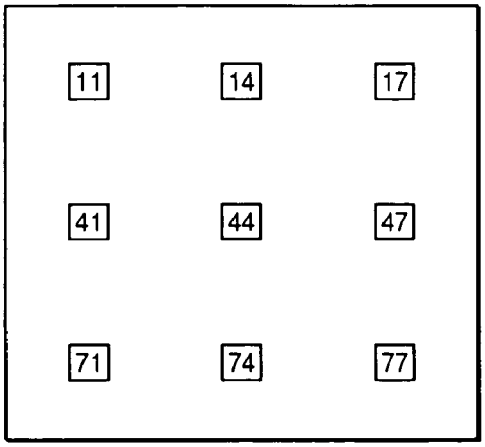
Figure 15D:
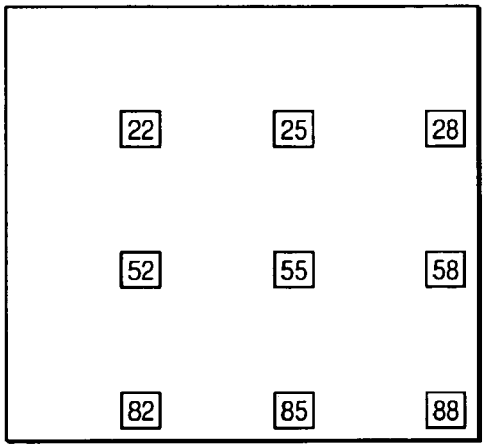

FIG. 15(A) illustrates an image data before reduction supplied from the outside; FIG. 15(B) a pixel data written in the display memory 206, when the setting of ⅓ reduction is made to store the image data after thinning the first rows and columns; FIG. 15(C) a pixel data written in the display memory 206, when the setting of ⅓ reduction is made to store the image data after thinning the second rows and columns; and FIG. 15(D) a pixel data written in the display memory 206, when the setting of ⅓ reduction is made to store the image data after thinning the third rows and columns.

Figure 13:
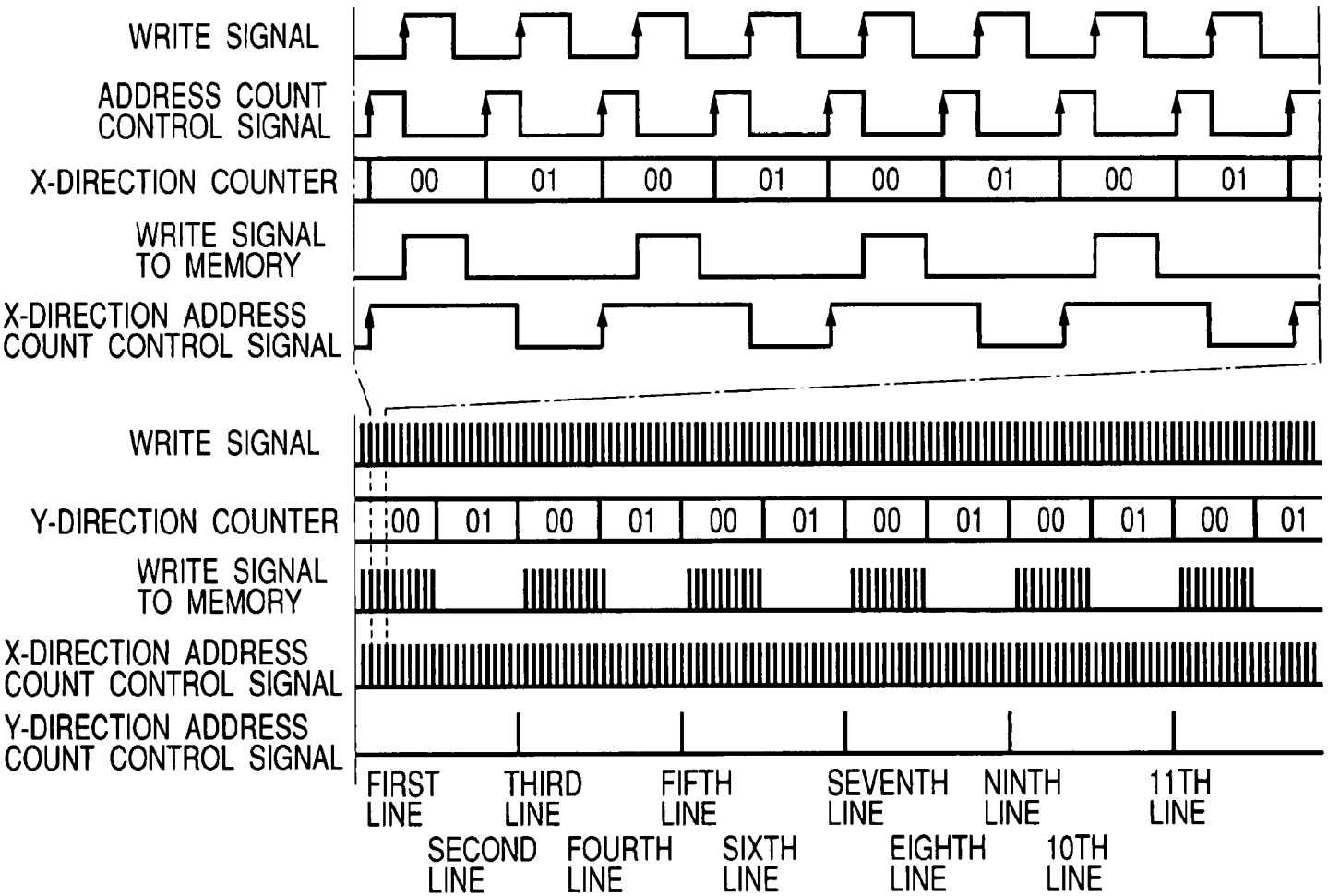
FIG. 13 is a timing chart illustrating the timings of signals in the resizing processing circuit of the second embodiment.

FIG. 13 illustrates the timings of the input/output signals and the internal signals of the resizing processing circuit 20 when the reduction rate is set to ½. As seen in FIG. 13, the write enable signal WE is made active (High level) only once for two cycles of the reference write signal. And, the X-direction counter 21 and the Y-direction counter 22 are reset when the counter values thereof each are '01', that is, they repeat '0' and '1' in terms of the decimal number. When the reduction rate is set to ⅓, the X-direction counter 21 and the Y-direction counter 22 are reset when the counter values thereof each are '10'. When the reduction rate is set to ¼, the X-direction counter 21 and the Y-direction counter 22 are reset when the counter values thereof each are '11'. When the counter is a 2-bit counter, the resizing rate can be set through to ¼. A 3-bit counter will set the resizing rate through to ⅛.

Table 2 shows the relation between the allocations of the reduction setting bits and the image sizes in the resizing register RSZ. Table 3 shows the relation between the allocations of the bits for setting the locations of thinned pixels and the locations of thinned pixels in the resizing register RSZ. Table 4 shows the relation between the bit allocations and the number of pixel remainders in the remainder register RCV for setting the number of vertical pixel remainders. Here, the remainder register RCH for setting the number of horizontal pixel remainders can be configured in the same manner as the remainder register RCV, and the explanation thereof will be omitted.

TABLE 2

| RSZ2 | RSZ1 | RSZ0 | Reduction rate |
|---|---|---|---|
| 0 | 0 | 0 | 1/1 |
| 0 | 0 | 1 | 1/2 |
| 0 | 1 | 0 | 1/3 |
| 0 | 1 | 1 | 1/4 |
| 1 | 0 | 0 | 1/5 |
| 1 | 0 | 1 | 1/6 |
| 1 | 1 | 0 | 1/7 |
| 1 | 1 | 1 | 1/8 |

TABLE 3

| DWP2 | DWP1 | DWP0 | Reduced to ½ | Reduced to ⅓ | Reduced to ¼ | Reduced to ⅛ |
|---|---|---|---|---|---|---|
| 0 | 0 | 0 | $1^{st}$ pixel | $1^{st}$ pixel | $1^{st}$ pixel | $1^{st}$ pixel |
| 0 | 0 | 1 | $2^{nd}$ pixel | $2^{nd}$ pixel | $2^{nd}$ pixel | $2^{nd}$ pixel |
| 0 | 1 | 0 | Setting inhibit | $3^{rd}$ pixel | $3^{rd}$ pixel | $3^{rd}$ pixel |
| 0 | 1 | 1 | Setting inhibit | Setting inhibit | $4^{th}$ pixel | $4^{th}$ pixel |
| 1 | 0 | 0 | Setting inhibit | Setting inhibit | Setting inhibit | $5^{th}$ pixel |
| 1 | 0 | 1 | Setting inhibit | Setting inhibit | Setting inhibit | $6^{th}$ pixel |
| 1 | 1 | 0 | Setting inhibit | Setting inhibit | Setting inhibit | $7^{th}$ pixel |
| 1 | 1 | 1 | Setting inhibit | Setting inhibit | Setting inhibit | $8^{th}$ pixel |

TABLE 4

| RCV2 | RCV1 | RCV0 | Pixel remainder (vertical) |
|---|---|---|---|
| 0 | 0 | 0 | 0 |
| 0 | 0 | 1 | 1 |
| 0 | 1 | 0 | 2 |
| 0 | 1 | 1 | 3 |
| 1 | 0 | 0 | 4 |
| 1 | 0 | 1 | 5 |
| 1 | 1 | 0 | 6 |
| 1 | 1 | 1 | 7 |

Figure 16A:
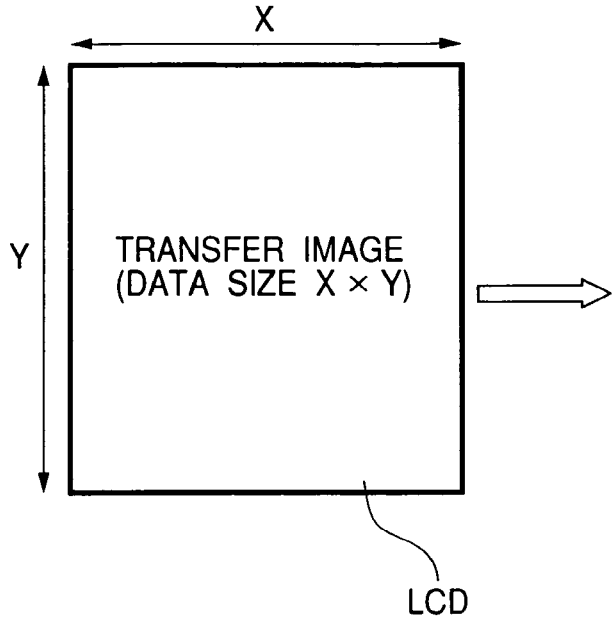
FIGS. 16(A) and 16(B) are an explanatory chart illustrating the storage states of the image data before the resizing processing in the second embodiment and the compressed data in the memory after the resizing processing.
Figure 16B:
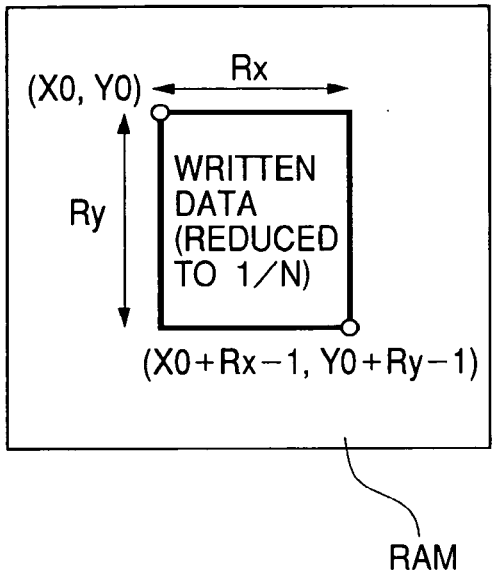

Now, on the assumption that there is a need for reducing a transfer image of a data size X×Y (X, Y: number of pixels) as illustrated in FIG. 16(A) to 1/N, and storing the reduced image data in an arbitrary storage region (starting position X, Y0) of the display memory (RAM), as shown in FIG. 16(B), a method will be explained in which an external microcomputer sets the data into a specified register inside the control register CTR. Here, N is a positive integer.

The external microcomputer sets (N−1) in a region for setting locations of thinned pixels in the resizing register RSZ. The reason to set (N−1) is that the reduction rate is 1/1 in case of N=1, and the bits for setting the locations of thinned pixels RSZ2, RSZ1, RSZ0 are "000" (equivalent to '0' in the decimal number) in case of the reduction rate 1/1 from Table 2. The bits for setting the locations of thinned pixels of the resizing register RSZ can be set freely in a range where the setting is not inhibited according to the reduction rate in Table 3. The number L of vertical pixel remainders to be set in the register RCV can be calculated from the number of pixels X and the reduction rate N, by using the arithmetic expression L=X mod N. In the same manner, the number M of horizontal pixel remainders to be set in the register RCH can be calculated from the number of pixels Y and the reduction rate N, by using the arithmetic expression M=Y mod N.

Further, in addition to the above registers, the external microcomputer needs to set an address X0, Y0 into the address register AD for setting write starting positions in the display memory, and to set addresses X0, X0+Rx−1, Y0, Y0+Ry−1 into the window address registers HSA, HEA, VSA, VEA for setting write regions. Here, Rx and Ry represent the sizes of the data write regions inside the display memory 206, and they can be calculated from the expressions Rx=(X−L)/N, Ry=(Y−M)/N, by using the numbers of pixels X, Y of the transfer image, the numbers of pixel remainders L, M, and the reduction rate N.

According to this embodiment, with conditions that the external microcomputer sets specified registers in advance, inputs instructions to designate the resizing, and executes the same data transfer as the normal data write, the image reduction (image resizing) can be made automatically inside the liquid crystal controller driver 200, and the reduced image data are stored in the display memory 206. To use this function will make it possible, for example, to create plural thumbnail images (list of reduced images), and to display an image transmitted from a partner through a mobile telephone with a camera on the whole screen and display an image photographed by the own camera in a reduction rate on part of the screen in a short time, which is advantageous.

In a mobile telephone with a camera having a main image panel and a sub-image panel, in combination with the first embodiment, by providing for memory spaces for the main image panel and the sub-image panel, and the α blending and the resizing in the memory space of the display RAM, although the occupancy area of the display RAM becomes large, while displaying an image to be photographed on the whole screen of the main image in using the camera to thereby confirm the photographed image, and making a photographing partner confirm an image being photographed in a reduced display by the resizing on the sub-screen, it will be possible to make a transparent display of information such as the time and the state of the mobile telephone on the main panel by the α blending, and to resize an image transmitted from the outside and display to superpose the reduced image on the main panel with a transparent state by the α blending. And, to apply the correction of the γ characteristic according to this invention to the above case will make it possible to drive both the main image panel and the sub-image panel with the voltages from one gradation voltage generator without deterioration of the image quality, and to achieve reduction of the power consumption and the chip area.

By the method of setting the data into the address register AD for setting write starting positions and the window address registers HSA, HEA, VSA, VEA for setting write regions, it is possible to store image data compressed by the resizing processing circuit 20 in a storage area for the first image data, and to display the image on the second liquid crystal panel 120, in which the basic image data stored in the storage area for the second image data and the compressed image data are synthesized.

Next, the third embodiment of this invention will be described. In addition to the functions of the first embodiment, the third embodiment has a function that scans the gate lines of the liquid crystal panel being not displayed with a longer cycle than the period of being displayed to thereby prevent deterioration of the liquid crystal.

In the system that drives the liquid crystal display device 100 having the two liquid crystal panels 110 and 120 sharing the source lines, when a user desires to halt the display on one liquid crystal panel because it is unnecessary, a voltage applied to the source lines for driving the other liquid crystal panel is also applied to the liquid crystal of the non-display liquid crystal panel. In this case, when the scan operation is halted to the gate lines of the non-display liquid crystal panel, the ac voltage is not applied to the liquid crystal, which leads to a possibility of deteriorating the liquid crystal.

Figure 18:
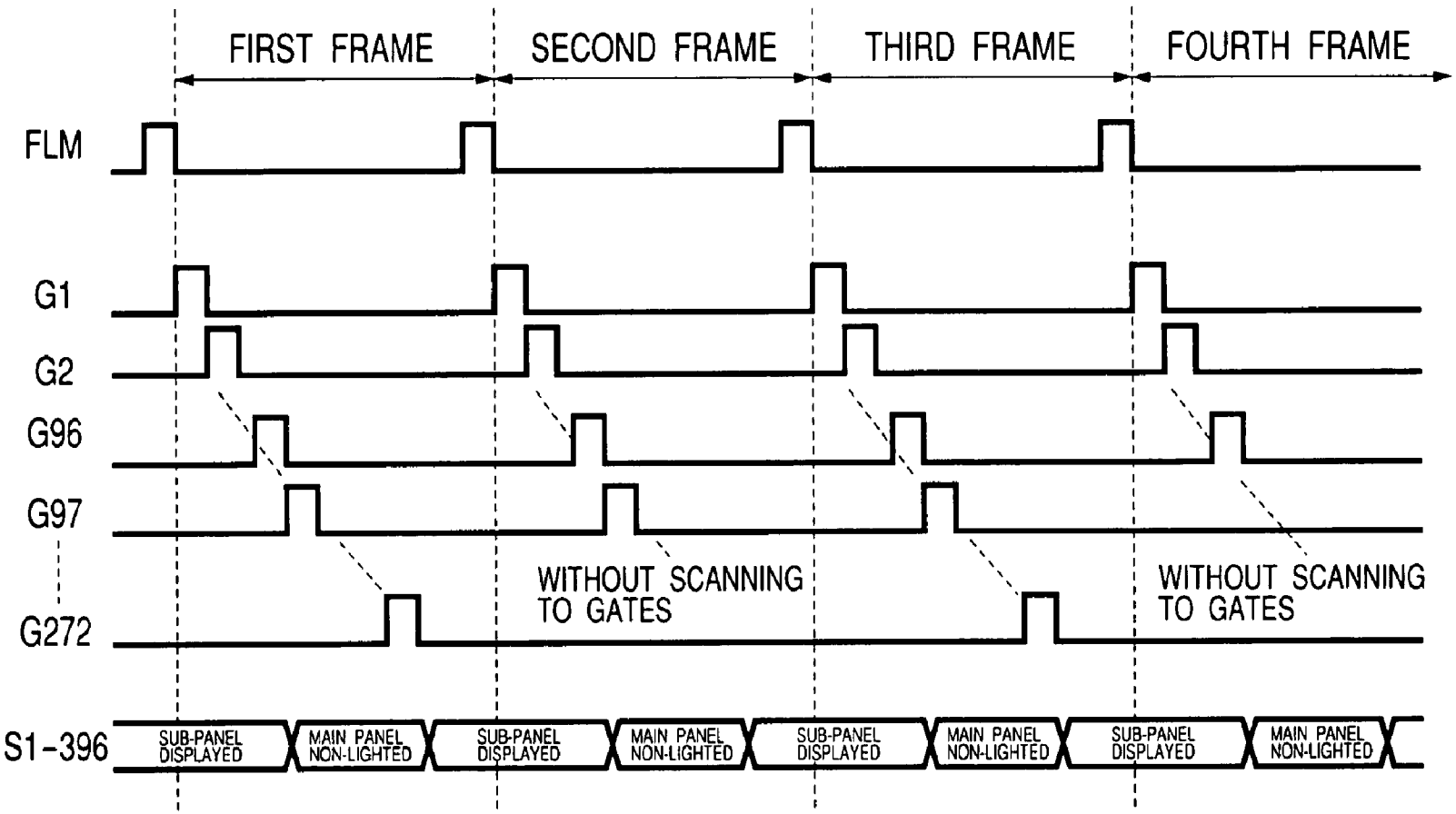
FIG. 18 is a timing chart illustrating the operational timings of interval scan in the liquid crystal controller driver having the third embodiment applied thereto.

Accordingly, the liquid crystal controller driver of this embodiment performs the scan operation also to the gate lines of the non-display liquid crystal panel to prevent deterioration of the liquid crystal, and at the same time, it makes the scan cycle sufficiently long in comparison to the case of the normal display drive to achieve reduction of the power consumption. FIG. 18 illustrates an example of the timing of gate line drive signals, when the sub-screen on the first liquid crystal panel 110 displays a normal display, and the main screen on the second liquid crystal panel 120 halts a display.

According to the timing illustrated in FIG. 18, the drive pulses are applied once each frame to the gate lines G1 to G96 for the first liquid crystal panel 110; however, to the gate lines G97 to G272 for the second liquid crystal panel 120, the drives pulses are applied every odd frames. For the conveniences of the drawing, FIG. 18 illustrates a case of applying the drives pulses every odd frames to the gate lines G97 to G272 for the non-display second liquid crystal panel 120. However, it is preferable to set the scan cycle to the gate lines for the non-display liquid crystal panel to a long time as far as possible, within a permissible range to prevent deterioration of the liquid crystal. Thereby, the drive pulses are to be applied with a predetermined interval to the gate lines for the non-display liquid crystal panel. As the result, an ac voltage is to be applied to the liquid crystal of the non-display liquid crystal panel, which prevents deterioration of the liquid crystal.

The liquid crystal controller driver of this embodiment is configured to apply to the source lines a voltage corresponding to the pixel data to display the black color, to synchronize with the scan operation of the gate lines for the non-display liquid crystal panel. Since the voltage corresponding to the pixel data to display the black color is lower than a voltage corresponding to the pixel data to display the white color, the liquid crystal panel of this embodiment saves the power loss accompanied with the charge and discharge of pixel electrodes, in comparison to the case of displaying the white color. To the liquid crystal panel in which the voltage corresponding to the pixel data to display the white color is lower, a voltage to display a color may be applied during the non-display.

Figure 19:
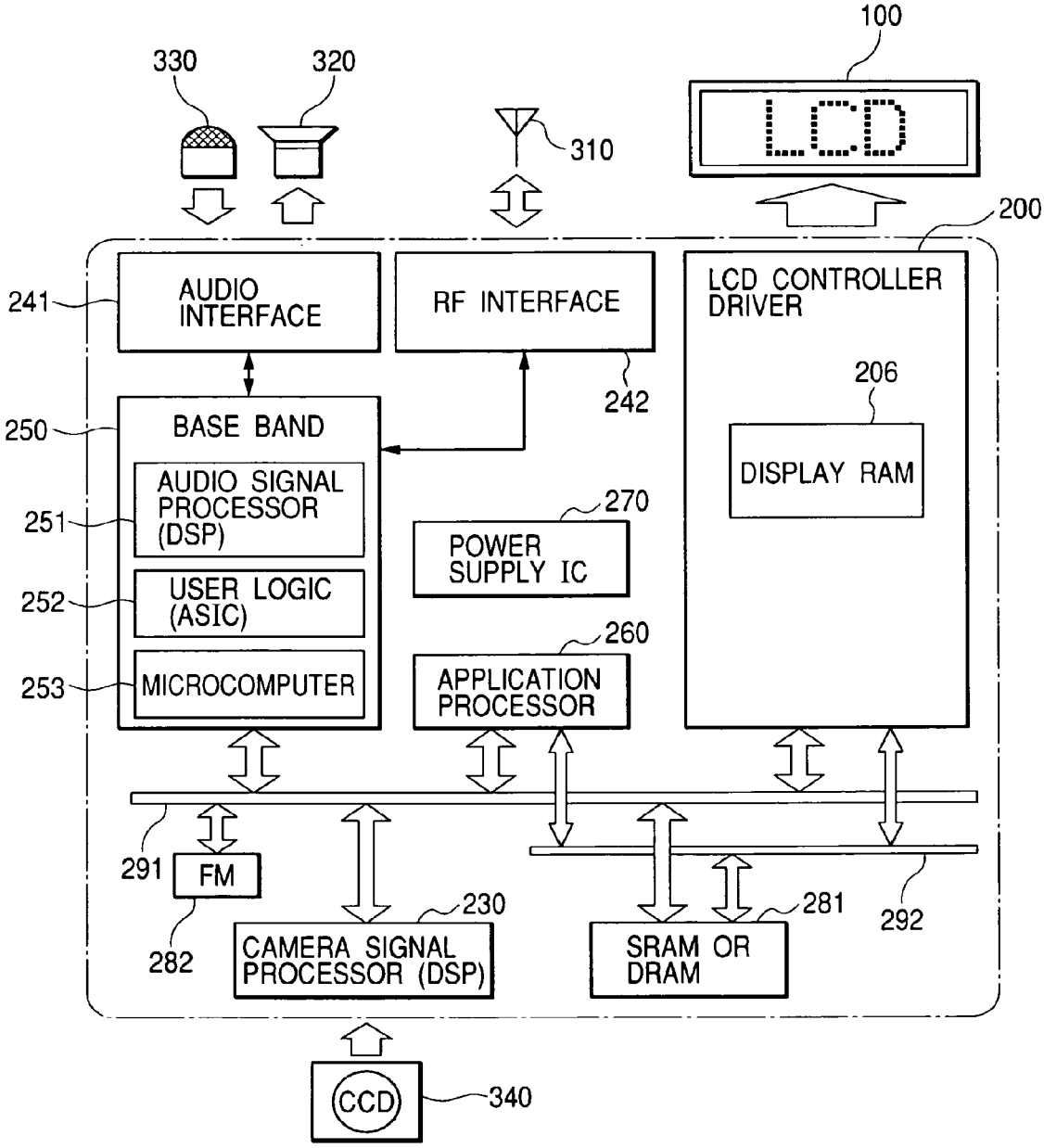
FIG. 19 is a block diagram illustrating the total configuration of a mobile telephone as an example of the applied system of the liquid crystal controller driver having the invention applied thereto.

FIG. 19 illustrates the total configuration of a mobile telephone as an example of the system provided with the liquid crystal display drive control device (liquid crystal controller driver) of this invention.

The mobile telephone of this embodiment includes the liquid crystal display device 100 as a display means, a transmitting/receiving antenna 310, a speaker 320 for audio outputs, a microphone 330 for audio inputs, a solid image sensor 340 composed of a CCD (Charge Coupled Device) and a MOS sensor, an image signal processor 230 composed of a DSP (Digital Signal Processor) that processes image signals from the solid image sensor 340, the liquid crystal controller driver 200 as the liquid crystal display drive control device relating to this invention, an audio interface 241 that inputs/outputs audio signals to and from the speaker 320 and the microphone 330, an RF interface 242 that inputs/outputs signals to and from the antenna 310, a base band unit 250 that executes the signal processing relating to the audio signals and transmission/reception signals, an application processor 260 composed of a microprocessor having a multimedia processing function such as animation processing conforming to the MPEG system, a resolution adjustment function, a Java high-speed processing function and so forth, a power supply IC 270, memories 281, 282 for data storage, and so forth.

The application processor 260 has the function that processes animation data received from other mobile telephones through the RF interface 242 as well as image signals from the solid image sensor 340. The liquid crystal controller driver 200, base band unit 250, application processor 260, memories 281, 282, and image signal processor 230 are connected by way of a system bus 291, so that they can transfer data each other. In the mobile telephone system in FIG. 19, a display data bus 292 is provided other than the system bus 291. The liquid crystal controller driver 200, application processor 260, and memory 281 are connected to this display data bus 292.

The base band unit 250 includes an audio signal processor 251 made up with a DSP (Digital Signal Processor), for example, an ASIC (application specific integrated circuits) 252 that provides a custom function (user logic), a microcomputer 253 as the system control device that controls generation of the base band signals, the display, and the total system, etc.

The memory 281 is a volatile memory, which is generally configured with an SRAM or SDRAM, and is used as a frame buffer that stores image data having experienced various image processing and so forth. The memory 282 is a non-volatile memory, which is configured with a flush memory capable of erasing collectively in a unit of specific block, for example, and is used for storing the control programs and control data of the whole mobile telephone system including the display control.

This system using the liquid crystal controller driver of the aforementioned embodiment can use a color TFT liquid crystal panel of the dot-matrix system having the display pixels arrayed in matrix as the liquid crystal display device 100. Further, in case the liquid crystal display device 100 has two screens as shown in FIG. 2, one liquid crystal controller driver is able to drive it.

Being described concretely based on the embodiments, the invention is not limited to the embodiments, and it should be well understood that various changes and modifications are possible without a departure from the spirits and scope of the invention. For example, in the description of the color liquid crystal panel driven by the liquid crystal display drive control device of the aforementioned embodiments, the pixels of the same color of RGB are arranged on the same columns. However, if a circuit that converts the transfer order of the RGB image signal from R-G-B into G-B-R or B-R-G is provided between the liquid crystal controller driver 200 and the liquid crystal panel, the invention will also be applied to such a liquid crystal panel as the pixels of the RGB are arranged in order in the column direction. Further, the aforementioned embodiments describes that the liquid crystal display drive control device includes the gate line driver 219; however, the invention can be applied to a case in which the gate line driver is configured separately in another semiconductor integrated circuit.

The invention has been described in relation to the drive control device of a liquid crystal display device being the background applicable field thereof, and a mobile telephone applying the drive control device; however, the invention is not limited to that, and it can be applied to the drive control device of a dot-matrix type display device other than liquid crystal display devices, and various types of portable electronic devices, such as PHS (Personal Handy-phone System) other than mobile telephones, and PDA, etc.

The typical effects to be obtained from the present invention disclosed in this specification are briefly described as follows.

According to the invention, since the arithmetic operation of the transparent display is carried out on the side of the liquid crystal display drive control device, the display drive control device is able to lighten the burden imposed on the microprocessor, in a system including a color liquid crystal panel, the liquid crystal display drive control device for driving the panel, and a microprocessor.

According to the invention, in case of repeatedly switching a transparent display and a non-transparent display, the microprocessor does not need to read out image data from the external memory and send the data to the liquid crystal display drive control device, each time the display is switched. Since only the instruction can switch the display contents by using the image data stored in the display memory inside the liquid crystal display drive control device, it is possible to realize a display system that switches the displays swiftly and saves the power consumption.

According to the invention, the storage capacity of the built-in memory is set to a size in which the sizes of the image data of the two liquid crystal panels are totalized, and the other image data to be overlapped for a transparent display are stored in the storage area corresponding to either of the panels being not used. Therefore, it is possible to efficiently manage the built-in memory of a small storage capacity and diversify the display. It is also possible to diminish the storage capacity of the display memory that is incorporated in the liquid crystal display drive control device in comparison to a system having the same function, and to reduce not only the chip size but also the cost.

According to the invention, since the gradation voltages are generated in accordance with the $\gamma$ characteristics of the liquid crystal panels being used, in a system containing more than two liquid crystal panels, one unit of the display drive control device is able to drive more than the two liquid crystal panels at optimum in accordance with each of the characteristics of the panels.

What is claimed is:

1. A display controller on one semiconductor substrate, the display controller comprising:

a memory capable of storing first display data to be displayed by a first display panel and second display data to be displayed by a second display panel;

a first register capable of setting first gradation voltage information corresponding to a characteristic of the first display panel;

a second register capable of setting second gradation voltage information corresponding to a characteristic of the second display panel;

a gradation voltage generation circuit capable of providing gradation voltages according to the first or the second gradation voltage information stored in the first or the second register; and a first driver circuit coupled to the gradation voltage generation circuit and capable of providing to the first or the second display panel driving signals as the corresponding gradation voltages according to the first or the second display data from the memory.

2. A display controller according to claim 1, further comprising:

an interface circuit by which the first and the second gradation voltage information to be stored in the first and the second registers are provided from outside of the display controller.

3. A display controller according to claim 1, further comprising:

a second driver circuit capable of providing a first signal for a scan drive of selection lines on the first display panel and a second signal for a scan drive of selection lines on the second display panel, wherein the second driver circuit provides the second signal to the second display panel after the scan drive of the selection lines on the first display panel is performed by providing the first signal, wherein the gradation voltage generation circuit provides the gradation voltages according to the first gradation voltage information stored in the first register when driving the first display panel, and provides the gradation voltages according to the second gradation voltage information stored in the second register when driving the second display panel.

4. A display controller according to claim 3, wherein a specified interval is provided when the drive of the first display panel is transferred into the drive of the second display panel, and wherein during the specified interval, the generation of the gradation voltages according to the first gradation voltage information in the first register is switched to the generation of the gradation voltages according to the second gradation voltage information in the second register.

5. A display controller on one semiconductor substrate, the display controller comprising:

a memory capable of storing first display data to be displayed by a first display panel and second display data to be displayed by a second display panel;

a first register capable of setting first gradation voltage information corresponding to a characteristic of the first display panel;

a second register capable of setting second gradation voltage information corresponding to a characteristic of the second display panel;

a gradation voltage generation circuit capable of providing gradation voltages according to the first or the second gradation voltage information stored in the first or the second register;

a source driver circuit coupled to the gradation voltage generation circuit and capable of providing to source lines of the first or the second display panel driving signals as the corresponding gradation voltages according to the first or the second display data from the memory;

a gate driver circuit capable of providing a first signal for a scan drive of gate lines of the first display panel and a second signal for a scan drive of gate lines of the second display panel; and an interface circuit capable of receiving the first and second gradation voltage information to be set to the first and the second registers, respectively, from outside the display controller, wherein the gate driver circuit provides the second signal to the gate lines of the second display panel after the scan drive of the gate lines of the first display panel is performed by providing the first signal, wherein the gradation voltage generation circuit provides the gradation voltages according to the first gradation voltage information stored in the first register when driving the first display panel, and provides the gradation voltages according to the second gradation voltage information stored in the second register when driving the second display panel.

6. A display controller according to claim 5, wherein a display period to display with the first and the second display panel is one frame period which includes:

a back porch period, a first display period to display with the first display panel, a middle porch period, a second display period to display with the second display panel, and a front porch period, wherein the gate driver circuit stops the first and the second signal during the back porch period, the middle porch period and the front porch period, provides the first signal during the first display period, and provides the second signal during the second display period, and wherein a supply of the first or the second gradation voltage information to the gradation voltage generation circuit is changed during the back porch period, the middle porch period and the front porch period.

7. A display controller according to claim 5, wherein the gradation voltage generation circuit includes:

a plurality of resistors coupled between a first supply terminal and a second supply terminal;

a plurality of selection circuits capable of selecting ones of voltages provided from the plurality of resistors based on the first or the second gradation voltage information in the first or the second register; and a plurality of amplifiers coupled to outputs of the plurality of selection circuits.

8. A display controller according to claim 7, further comprising:

a control circuit capable of providing a change signal to change a period of displaying by the first display panel or a period of displaying by the second display panel; and a selector responsive to the change signal and capable of providing one of the gradation voltage information in the first register and the second gradation voltage information in the second register to the plurality of selection circuits.

9. A mobile telephone comprising:

a microcomputer;

a first display panel;

a second display panel; and a display controller driver on one semiconductor substrate, the display controller driver comprising:

a memory capable of storing first display data to be displayed by a first display panel and second display data to be displayed by a second display panel;

a first register capable of setting first gradation voltage information corresponding to a characteristic of the first display panel;

a second register capable of setting second gradation voltage information corresponding to a characteristic of the second display panel;

a gradation voltage generation circuit capable of providing gradation voltages according to the first or the second gradation voltage information stored in the first or the second register;

a source driver circuit coupled to the gradation voltage generation circuit and capable of providing to source lines of the first or the second display panel driving signals as the corresponding gradation voltages according to the first or the second display data from the memory;

a gate driver circuit capable of providing a first signal for a scan drive of gate lines of the first display panel and a second signal for a scan drive of gate lines of the second display panel; and an interface circuit capable of receiving the first and second gradation voltage information to be set to the first and the second registers, respectively, from the microcomputer, wherein the gate driver circuit provides the second signal to the gate lines of the second display panel after the scan drive of the gate lines of the first display panel is performed by providing the first signal, wherein the gradation voltage generation circuit provides the gradation voltages according to the first gradation voltage information stored in the first register when driving the first display panel, and provides the gradation voltages according to the second gradation voltage information stored in the second register when driving the second display panel.

10. A mobile telephone according to claim 9, wherein a display period to display with the first and the second display panel is one frame period which includes:

a back porch period, a first display period to display with the first display panel, a middle porch period, a second display period to display with the second display panel, and a front porch period, wherein the gate driver circuit stops the first and the second signal during the back porch period, the middle porch period and the front porch period, provides the first signal during the first display period, and provides the second signal during the second display period, and wherein a supply of the first or the second gradation voltage information to the gradation voltage generation circuit is changed during the back porch period, the middle porch period and the front porch period.

11. A mobile telephone according to claim 9, the source lines of the first display panel are coupled to the source lines of the second display panel.

12. A mobile telephone according to claim 9, wherein the display controller driver is mounted on a glass substrate on which the second display panel is constructed.

13. A mobile telephone according to claim 9, wherein the first display panel is located outside of an upper lid of the mobile telephone, and the second display panel is located inside of the upper lid of the mobile telephone.

14. A mobile telephone according to claim 9, wherein the first display panel is a black-and-white liquid crystal display panel or a reflective liquid crystal display panel, and wherein the second display panel is a TFT type color liquid crystal display panel with backlighting function.

* * * * *